US005264829A

United States Patent [19]

Paul et al.

[11] Patent Number: 5,264,829

[45] Date of Patent: Nov. 23, 1993

[54] METHOD AND APPARATUS FOR THEFT DETECTION USING DIGITAL SIGNAL PROCESSING

[75] Inventors: Christopher R. Paul, Bayport; David T. Lundquist, Stonybrook, both of N.Y.

[73] Assignee: Knogo Corporation, Hauppauge, N.Y.

[21] Appl. No.: 898,687

[22] Filed: Jun. 15, 1992

[51] Int. Cl.[5] ..... G08B 13/18

[52] U.S. Cl. ..... 340/572; 307/520

[58] Field of Search ..... 340/572, 554; 307/520, 307/518, 511, 510

[56] References Cited

U.S. PATENT DOCUMENTS

| | | | |
|---|---|---|---|
| 4,623,877 | 11/1986 | Buckens | 340/572 |
| 5,023,598 | 6/1991 | Zemlok et al. | 340/572 |
| 5,103,209 | 4/1992 | Lizzi et al. | 340/572 |

OTHER PUBLICATIONS

"Digital Filters", pp. 67-69 and 135-137.

"Automatic Equalization for Digital Communication", R. W. Lucky, The Bell System Tech. J., vol. XLIV, No. 4, Apr. 1965, pp. 547-588.

"An Automatic Equalizer for General Purpose Communication Channels", Lucky, et al., The Bell System Tech. J., vol. VLIV, No. 9, Nov. 1967 pp. 2179-2208.

Drawing, "Retrofit board for MM200", KNOGO Corporation, Hauppauge, N.Y., Jun. 20, 1990.

*Primary Examiner*—Glen R. Swann, III

*Attorney, Agent, or Firm*—Fitzpatrick, Cella, Harper & Scinto

[57] ABSTRACT

Signals received by an electronic article surveillance system are processed digitally to ascertain the variation in magnitude of successive signals and to prevent the actuation of an alarm when the variation exceeds a predetermined amount; and signals whose frequency components have been phase shifted from a filtering operation are restored by passing them into a signal delay circuit, tapping the delay circuit at several points therealong into associated signal channels selectively amplifying or attenuating the signal in each channel and combining the signals in each channel.

38 Claims, 7 Drawing Sheets

FROM ANALOG TO DIGITAL CONVERTER 64 (SEE FIG. 3)
64a
FROM CYCLE CLOCK SIGNAL LINE 53 (SEE FIG. 3)
53
FROM SAMPLE CLOCK MULTIPLEXER 66 (SEE FIG. 3)
CYCLE CLOCK MULTIPLEXER
92
92a
92b1
92b2
92b3
92bN
N LINES
STORAGE
94
94N
94Na
94Nb
94a
94b
94N LINES
90
90a
90b
90c
100
102
104
104a
104b
106
108
110
112
114
Kth
N
116
116a
116b
116c
116d
TO AVERAGERS
FROM LONG TERM AVERAGER 138b

METHOD AND APPARATUS FOR THEFT DETECTION USING DIGITAL SIGNAL PROCESSING

BACKGROUND OF THE INVENTION

1. Field of the Invention

This invention relates to the processing of electrical signals and in particular it concerns novel methods and apparatus for utilizing digital signal processing in electronic theft detection.

2. Description of the Prior Art

U.S. Pat. No. 4,623,877 to Pierre F. Buckens and assigned to the assignee of the present invention discloses and claims methods and apparatus for detecting the unauthorized taking of objects from a protected area, such as a store. Articles taken from the store must pass through an interrogation zone into which electromagnetic interrogation energy is continuously radiated. If, while an article is brought through the interrogation zone, it has an active target mounted thereon, the target will respond to the electromagnetic interrogation energy in the zone and will produce disturbances of that energy in the form of pulses having unique characteristics. These pulses are detected by a receiver at the interrogation zone.

The Buckens invention makes use of signal processing to ascertain the average signal level in the interrogation zone at different portions of each interrogation cycle and to adjust the detection threshold level according to that level so that targets may be detected in the presence of other objects which may also produce interfering signals.

SUMMARY OF THE INVENTION

The present invention provides additional improvements to those of the Buckens invention. More specifically, the present invention, in one aspect, completely eliminates, in a novel manner, the effects of electromagnetic energy which is not synchronously related to signals which are to be detected. In another aspect, the invention makes target responses in an electronic article surveillance system more detectable by means of signal processing which substantially eliminates selected frequency components from energy to be detected and then replaces the original phase relationships among the remaining components, thereby preserving the unique characteristics of signals produced by the special targets attached to articles to be protected.

The present invention in one aspect involves novel methods and apparatus for processing signals of known periodicity by controlling their flow according to the amplitude variation among samples taken in corresponding time intervals in each of plural signal periods.

According to another aspect of the present invention there are provided novel methods and apparatus for detecting the presence, in an interrogation zone, of a target capable of producing predetermined electromagnetic disturbances which repeat at a first predetermined frequency and which have distinctive characteristics defined by frequency components in a frequency band principally less than a second, higher, predetermined frequency. These methods and apparatus comprise the steps of and apparatus for receiving electromagnetic disturbances from the interrogation zone and producing corresponding electrical signals, removing or filtering from the electrical signals, frequency components above a third frequency higher than the second frequency, detecting the magnitude of the remaining portions of the electrical signals during successive time intervals at a frequency at least twice the third frequency and which frequency is also a multiple of the first predetermined frequency, then comparing the detected magnitudes which occur in corresponding time intervals in successive cycles of the first predetermined frequency and producing an alarm signal in response to a predetermined comparison result.

According to further aspects of the invention there are provided other novel methods and apparatus for detecting the presence, in an interrogation zone, of a target capable of producing predetermined electromagnetic disturbances which repeat at a first predetermined frequency. These other novel methods and apparatus comprise the steps of and apparatus for receiving electromagnetic disturbances from the interrogation zone and for producing corresponding electrical signals, detecting the magnitude of the electrical signals during successive time intervals, which time intervals occur at a second frequency which is a predetermined multiple of the first predetermined frequency, comparing the detected magnitudes of the electrical signals which occur in corresponding time intervals in successive cycles of the first predetermined frequency to produce an alarm, and preventing the production of an alarm in those time intervals where the variation among the compared magnitudes fails to conform to a predetermined characteristic.

According to additional aspects of the invention there are provided further novel methods and arrangements for detecting the presence of a target in an interrogation zone. These further novel methods and apparatus comprise the steps of and apparatus for, detecting the electromagnetic radiation in the interrogation zone and producing electrical signals corresponding to the radiation, filtering from the electrical signals selected frequency components, restoring to the remaining components the relative phase relationship the remaining components had to each other prior to filtering, and detecting the presence of predetermined pulses in the restored components.

According to still further aspects of the invention there are provided novel methods and arrangements for augmenting, by predetermined amounts, the magnitude of signals from taps which are distributed along a signal delay circuit wherein the signals, after being so augmented, are connected to a common summing circuit. These other novel methods and arrangements comprise steps and apparatus for producing a difference signal representing the difference in magnitudes between the output of the summing circuit and a desired magnitude, multiplying the magnitude of a signal corresponding to the difference signal with each of the signals at the output of the delay line to produce individual adjustment signals, adding to these adjustment signals to previously produced tap coefficients to produce new tap coefficients, delaying the new tap coefficients and amplifying each tap output by an amount corresponding to its respective delayed new tap coefficient.

DETAILED DESCRIPTION OF THE PREFERRED EMBODIMENT

The present invention is applicable to any electronic article surveillance system in which a target causes rapid periodic electromagnetic disturbances. However, for purposes of illustration the invention will be described in conjunction with a so-called "magnetic" system in which an alternating magnetic field is introduced into an interrogation zone and targets on protected articles carried through the zone are driven alternately into and out of magnetic saturation by the alternating magnetic field. This produces periodic electromagnetic disturbances at frequencies which are harmonics of the original alternating magnetic field frequency. These harmonics, or selected ones of these harmonics, are detected and used to actuate an alarm.

Figure 1:
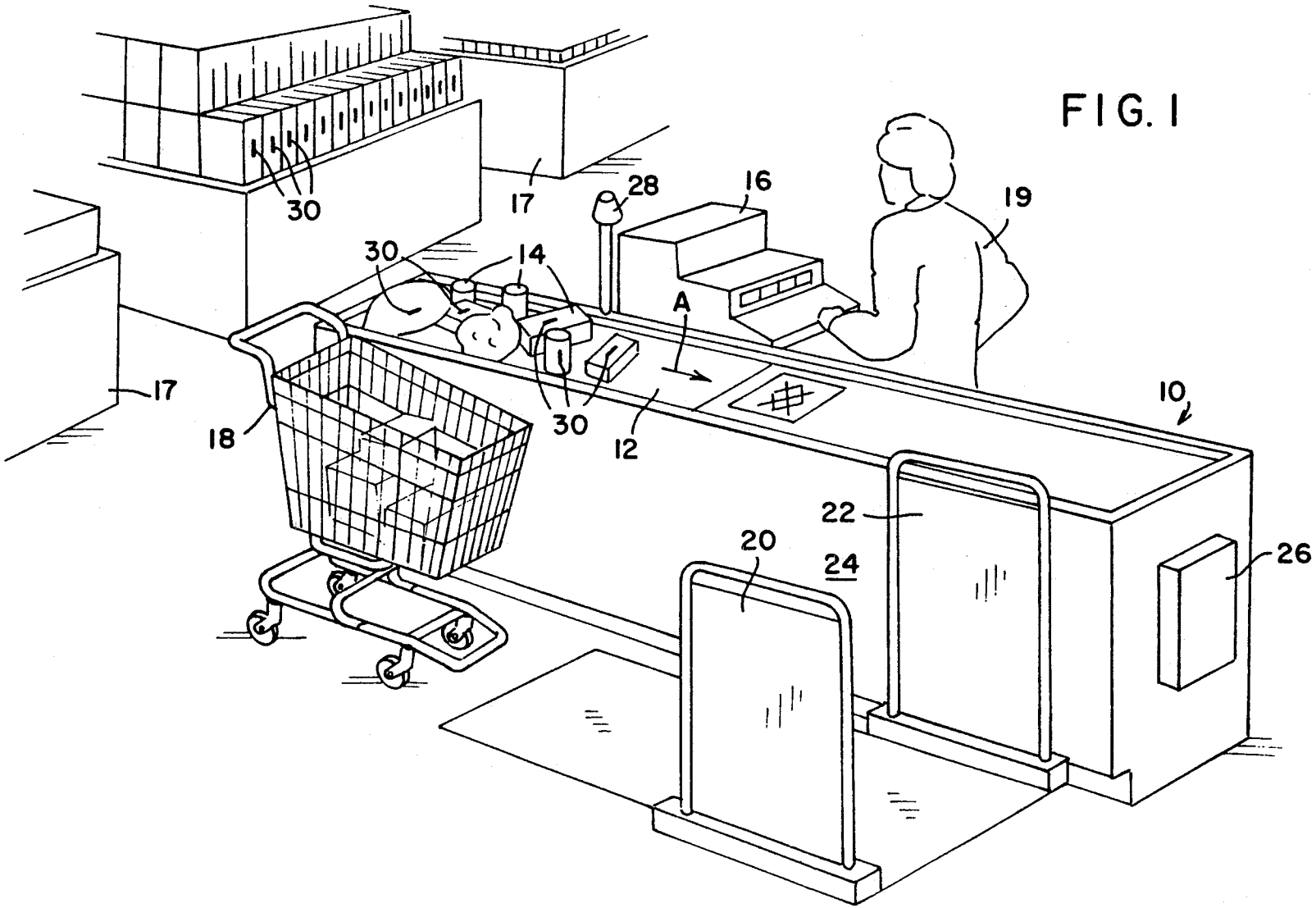
FIG. 1 is a perspective view of an electronic theft detection system embodying the present invention as installed in a supermarket.

The arrangement shown in FIG. 1 is used in a supermarket to protect against theft of merchandise. As shown, there is provided a supermarket checkout counter 10 having a conveyor belt 12 which carries merchandise, such as items 14 to be purchased, past a cash register 16, as indicated by an arrow A. A patron (not shown) who has selected goods from various shelves or bins 17 in the supermarket, takes them from a shopping cart 18 and places them on the conveyor belt 12 at one end of the counter 10. A clerk 19, standing at the cash register 16, records the price of each item of merchandise as it moves past on the conveyor belt. The items are paid for and are bagged at the other end of the counter. The theft detection system according to this embodiment of the invention may include a pair of spaced apart antenna panels 20 and 22 next to the counter 10 beyond the cash register 16. The antenna panels 20 and 22 are spaced far enough apart to permit the store patron and the shopping cart to pass between them.

The antenna panels 20 and 22 contain transmitter antennas which are simply loops or coils of wire or other conductive material capable of generating magnetic fields when electrical currents pass through them. These antennas generate an alternating magnetic field in an interrogation zone 24 between the panels.

The antenna panels 20 and 22 also contain receiver antennas, which are also conductive coils capable of converting incident electromagnetic energy to electrical currents. These receiver antennas thus produce electrical signals corresponding to variations in the magnetic interrogation field in the zone 24. The antennas are electrically connected to transmitter and receiver circuits contained in a housing 26 arranged on or near the counter 10. There is also provided an alarm, such as a light 28, mounted on the counter 10, which can easily be seen by the clerk and which is activated by the electrical circuit when a protected item 14 is carried between the antenna panels 20 and 22. If desired, an audible alarm may be provided instead of, or in addition to, the light 28.

Those of the items 14 which are to be protected against shoplifting are provided with targets 30. Each target 30 comprises a thin elongated strip of high permeability easily saturable magnetic material, such as permalloy. When protected items 14 are placed on the conveyor belt 12 they pass in front of the clerk 19 who may record their purchase. The items 14 which pass along the counter 10 do not enter the interrogation zone 24 and they may be taken from the store without sounding an alarm. However, any items which remain in the shopping cart 18, or which are carried by the patron cannot be taken from the store without passing between the antenna panels 20 and 22 and through the interrogation zone 24. When an item 14 having a target 30 mounted thereon enters the interrogation zone 24, it becomes exposed to the alternating magnetic interrogation field in the zone and becomes magnetized alternately in opposite directions and driven repetitively into and out of magnetic saturation. As a result, the target 30 disturbs the magnetic field in the interrogation zone in a manner such that pulses of magnetic energy are formed. These pulses, which are made up of frequency components at harmonics of the original or fundamental transmitted frequency, have a unique form, which makes it possible to detect their occurrence. The magnetic fields in the interrogation zone, including those which form the above described pulses, are intercepted by the receiver antenna which produces corresponding electrical signals. These electrical signals, as well as other internally generated electrical signals, are processed in the receiver circuits in a manner such that those produced by true targets can be distinguished from those produced by other electromagnetic disturbances and other internally generated electrical signals. Upon completion of such processing, the signals produced by true targets are then used to operate the alarm light 28. Thus the clerk 19 will be informed whenever a patron may attempt to carry unpurchased protected articles out of the store.

Figure 2:
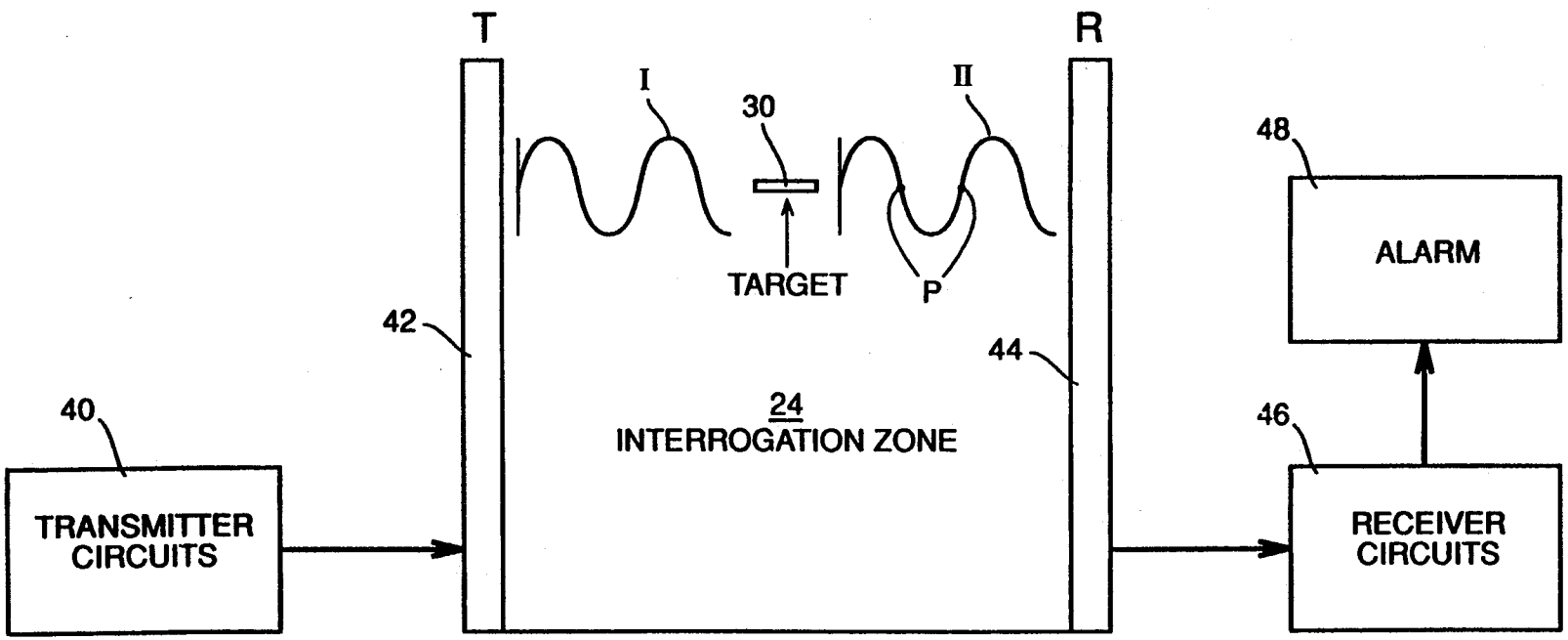
FIG. 2 is a diagrammatic view of the general components of the system of FIG. 1.

FIG. 2 is a diagrammatic representation of the system of FIG. 1 as seen from a position along the path of movement through the interrogation zone 24. As indicated, transmitter circuits 40 are connected to a transmitter antenna 42 on one side of the interrogation zone 24; and a receiver antenna 44 on the other side of the zone 24 is connected to receiver circuits 46. These receiver circuits in turn are connected to an alarm 48. It has been found preferable to provide transmitter and receiver antennas on both sides of the zone 24; but for purposes of illustration and explanation FIG. 2 shows a single transmitter antenna on one side and a single receiver antenna on the other side.

The transmitter circuits 40 generate a continuous alternating electrical signal in the form of a sine wave and at a fixed fundamental frequency, for example, 218 HZ. This electrical signal is converted by the transmitter antenna 42 into a corresponding alternating magnetic interrogation field in the interrogation zone 24. The transmitted interrogation field is represented by the waveform I near the transmitter antenna 42. As can be seen, this waveform is in the shape of a sine wave. A target 30 in the interrogation zone 24 disturbs the field transmitted by the transmitter antenna and produces small pulses P as shown in a waveform II near the receiver antenna. The waveform II is basically the same shape as the waveform I except that the waveform II is slightly displaced in time due to its transit time across the interrogation zone. Further, the waveform II has pulses superimposed thereon which are caused by the target 30 in the zone. It should be noted that the waveform II, which has the same fundamental frequency as the waveform I, is synchronized with the wave form I. In addition, the pulses P in the wave form II are also synchronized with the waveform I. These pulses are actually the sum of several frequency components which are harmonics of the fundamental frequency of the transmitted magnetic field.

The receiver antenna 44 converts magnetic fields which are incident thereon, including the waveform II, to corresponding electrical signals. These electrical signals are processed in the receiver circuits 46 to ascertain whether the magnetic field disturbances are those which have been caused by the presence of a true target 30 in the interrogation zone 24. If so, the receiver circuits send a signal to actuate the alarm circuit 48.

It should be understood that in addition to the magnetic field from the target 30 which produces the waveform II, there are several other magnetic fields incident on the receiver antenna 44. These other fields may be caused by spurious electromagnetic disturbances from electrical equipment such as motors, lights, radio transmission, etc., or even by "innocent" objects, such as shopping carts or other metallic objects which disturb the magnetic field produced by the transmitter antenna 42. In addition, internally generated electrical disturbances alter the electrical signals produced by the receiver antenna 44. The system described herein uses various signal processing techniques to distinguish those disturbances produced by the presence of a true target 30 in the interrogation zone from the above mentioned other disturbances. Some of these techniques have been used in the past. The novel features of the present invention provide improvements over these past techniques in the following respects: first, the present invention makes it possible to remove, rather than merely attenuate the effects of electrical and electromagnetic disturbances which are not synchronous with the transmitted magnetic field; and second, the present invention makes it possible to process the received electromagnetic signals without significant phase or delay distortion due to filtering so as to maintain the characteristic shapes of the received signals. These features will become apparent from the following description of the internal configuration of the transmitter and receiver circuits.

Figure 3:
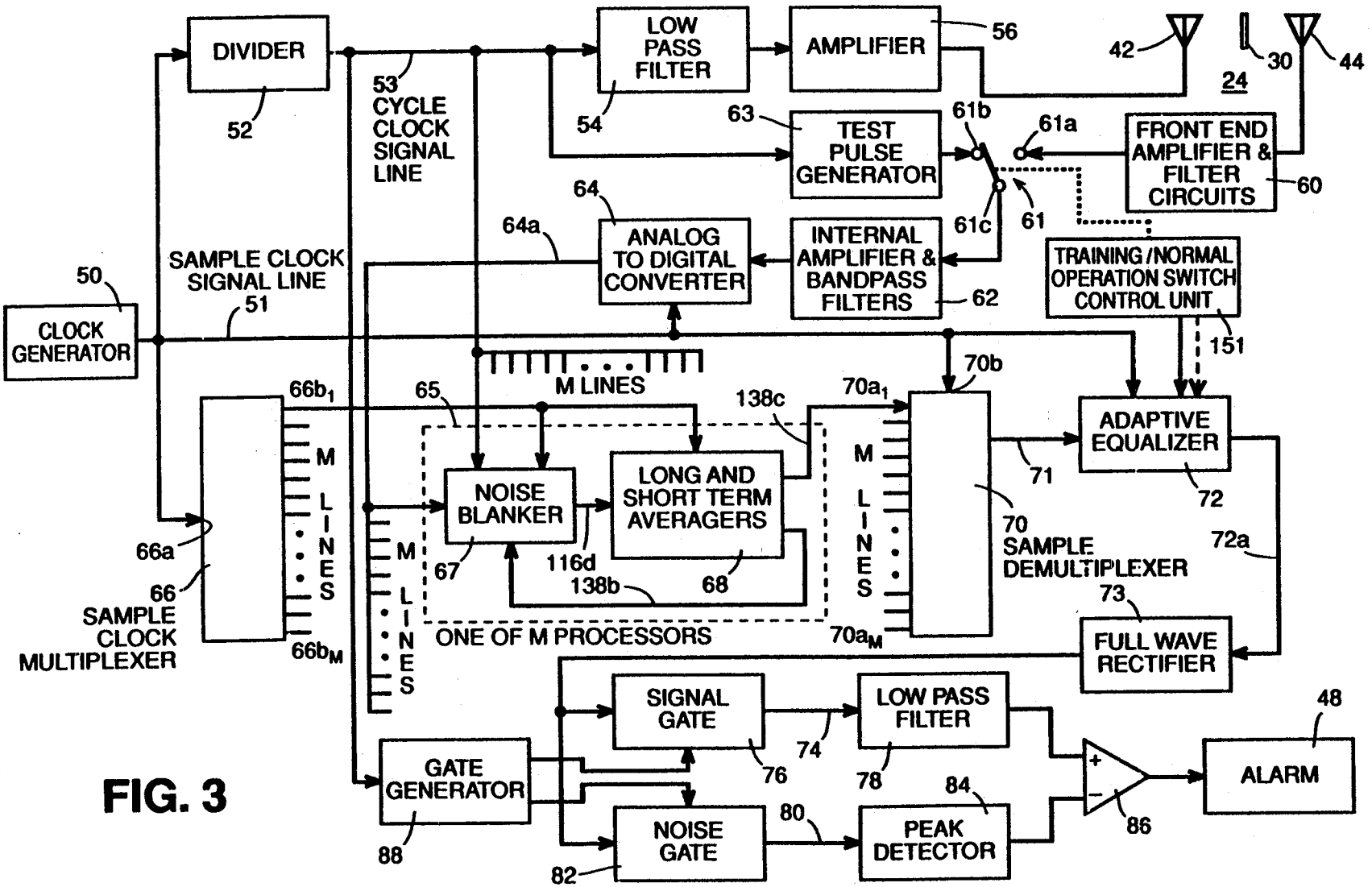
FIG. 3 is a block diagram of the components of the system of FIG. 1.

The overall block diagram of the transmitter and receiver circuits 40 and 46 is shown in FIG. 3. A clock generator 50 and a divider 52 are provided to synchronize the overall operation of the system. In this example the clock generator is chosen to produce pulses at a rate of 13,952 pulses per second on a sample clock signal line 51. The divider 52 is connected to the sample clock signal line 51 and is constructed to produce one output pulse for every 64 input pulses, that is, 218 pulses per second on a cycle clock signal line 53. The pulses from the divider 52 are applied to a low pass filter 54 which convert them to a continuous sine wave of 218 HZ. This sine wave is applied to an amplifier 56 which is connected to drive the transmitter antenna 42. The transmitter antenna 42 thus generates a continuous alternating magnetic field in the interrogation zone 24 as indicated by the waveform I in FIG. 2. The clock pulse generator 50, the divider 52, the low pass filter 54 and the amplifier 56 are all individually well known and no special form of any of these components is needed or desired in order to carry out the invention according to the best mode contemplated by the inventors.

Electromagnetic energy from the interrogation zone 24, including disturbances produced by a target 30, if present, as well as other electromagnetic disturbances that may be present, are received by the receiver antenna 44 and converted to corresponding electrical signals. These signals are applied to front end amplifier and filter circuits 60. These front end circuits are designed to remove or reduce unwanted components from the electrical signals generated by the receiver antenna 44, particularly the very large fundamental frequency of the transmitter signal (i.e. 218 HZ). The front end circuits 60 are also individually well known and no special form is needed to carry out the invention. As mentioned, the front end amplifier and filter circuits 60 remove or reduce the very large fundamental frequency component, i.e. the 218 HZ component. For this purpose a notch filter has been found to be the simplest and most effective way to reduce this component.

The front end amplifier and filter circuits 60 are connected through a first training/normal operation switch 61 (to be described more fully hereinafter) to internal amplifier and band-pass filter circuits 62. The purpose of these circuits is to attenuate frequency components above and below a predetermined frequency band. It has been found that those frequency components below the tenth and above the seventeenth harmonic of the fundamental frequency can be attenuated and the remaining components will closely represent the major distinctive features of the target produced pulses. Also, by attenuating the components above the seventeenth and below the tenth harmonic, a large portion of the interfering electrical energy from non-target sources is removed.

The internal amplifier and band-pass filter circuits 62 are also well known and no special construction thereof is considered to be the best mode for carrying out this invention. In the illustrated embodiment the filter portion of the internal amplifier and band-pass filter circuits 62 is made up of a 9th order Butterworth highpass filter with a cutoff frequency of 2 KHZ (kilohertz) and a 9th order 0.01 db (decibel) Chebyshev lowpass filter with 3db down or −3db at 3800 HZ cutoff. The output of the internal amplifier and band-pass filter circuits 62 is connected to an analog to digital converter 64 which produces a digital output corresponding to the amplitude of the signal from the circuits 62 at any instant.

The output from the analog to digital converter 64 is applied to each of M processors 65. Each processor comprises noise blanker circuits 67 and long and short term averager circuits 68. The output of each processor 65 is applied to a corresponding input $70a_1 \ldots 70a_M$ of a sample demultiplexer 70; and the single output of the sample demultiplexer 70 is applied to an adaptive equalizer 72.

In the illustrative embodiment, which is presently preferred the number M is chosen to be sixty-four, which accommodates sixty-four samples during each cycle of the fundamental frequency. The amplifiers and filters 60 and 62 are designed to pass the 10th through 17th harmonics of the fundamental frequency and to attenuate frequency components above and below this band. Because of the characteristics of the filters, frequency components up to the 32nd harmonic may be passed to some appreciable degree. Therefore, to ensure against aliasing, the sampling and processing by the M processors 65 is at a rate substantially in excess of twice that frequency, namely, the 64th harmonic.

The output of the adaptive equalizer 72 is applied through a full wave rectifier 73 to a signal channel 74, which contains a signal gate 76 and a low pass filter 78, and a noise channel 80, which contains a noise gate 82 and a peak detector 84. The outputs of the signal and noise channels 74 and 80 are compared in a comparator 86; and the comparator output is applied to the alarm 48. The signal and noise gates 76 and 82 are opened to pass signals along their respective signal and noise channels 74 and 80 at alternate times by gate signals from a gate generator circuit 88. The gate generator circuit 88 in turn receives pulses from the divider 52.

The portion of the system following the adaptive equalizer 72, namely the portion containing the full wave rectifier 73 and the signal and noise channels 74 and 80 is, in principle, the same as described in the above referred to U.S. Pat. No. 4,623,877 to Pierre F. Buckens, except that it is preferably implemented using well known digital circuits.

Here it should be understood that while the processors 65, the sample demultiplexer 70, the adaptive equalizer 72 and the remaining components are all shown and described herein using block diagrams, the functions of these items in actual practice would be carried out by means of solid state integrated circuit components formed on chips that have been specially programmed to perform the functions to be described. It should also be understood the actual manner of programming the integrated circuit components is not part of the invention nor does it concern the best mode of carrying out the invention. Any programmer of ordinary skill in the art can program solid state components to perform the functions to be described; and there are many different ways of carrying out this programming, with no particular one being considered to be better than any other.

The first training/normal operation switch 61 has a first input terminal 61*a* which is connected to the output of the front end amplifier and filter circuits 60, a second input terminal 61*b* which is connected to the output of a test pulse generator 63 and a common output terminal 61*c* which is connected to the input of the amplifier and bandpass circuits 62. The switch 61 is controlled by a programmed training/normal operation control unit 151, which also controls a second training/normal operation switch to be described hereinafter in connection with the adaptive equalizer 72. As shown, the adaptive equalizer 72 is also connected to receive signals from the training/normal operation switch control unit 151. Thus, depending on the setting of the first training/operation switch 61, signals are directed to the amplifier and bandpass filters 62 either from the receiver antenna 46 and front end circuits 60 or from the test pulse generator 63.

The test pulse generator 63 is connected to receive cycle clock signals from the output of the divider 52 and to produce from each of these pulses a pulse similar to that which would come from the front end circuits when a true target 30 is present in the interrogation zone. During a "training" period, prior to normal operation of the system, the training/operation switch 61 is set with its second input terminal 61*b* connected to its common output terminal 61*c* and the pulse signals from the test pulse generator 63 are at this time applied to the amplifier and band pass circuits 62. During normal operation of the system, the switch 61 is set with its first input terminal 61*a* connected to the common output terminal 61*c*, so that signals from the receiver antenna 46 and the front end circuits 60 are applied to the amplifier and band pass circuits 62.

Figure 4:
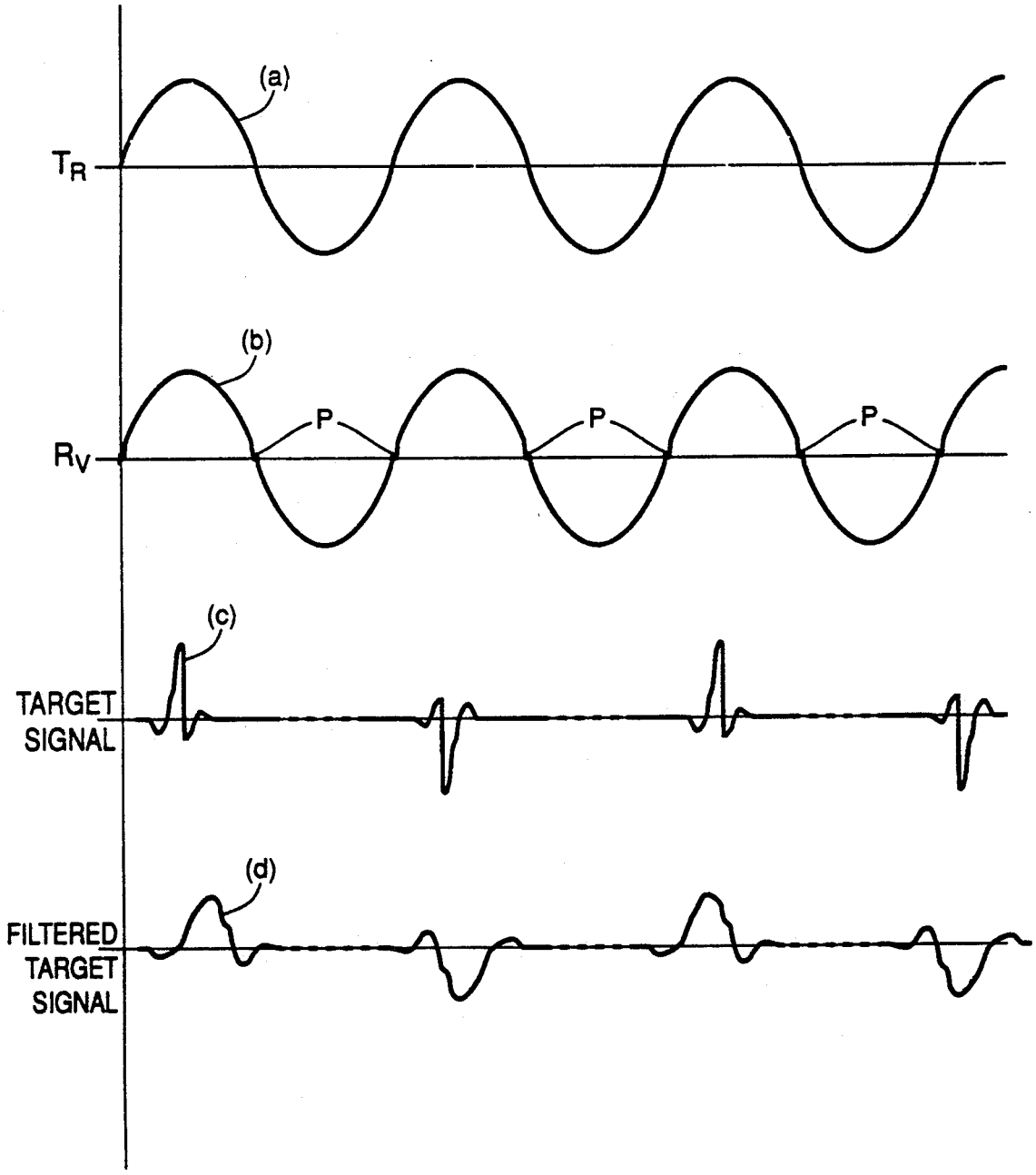
FIG. 4 is a series of waveforms showing the relative timing of signal processing in the system of FIG. 1.

Before describing the sample clock multiplexer 66, the noise blanker circuits 67, the averager circuits 68, the sample demultiplexer 70 and the adaptive equalizer 72, the general manner in which the system analyzes incoming signals will first be described in connection with FIG. 4. Waveform (a) of FIG. 4 represents the magnitude of the transmitted magnetic interrogation field which alternates at the fundamental frequency, which is the illustrative embodiment is 218 HZ. Waveform (b) of FIG. 4 represents the magnitude of an idealized signal incident on the receiver antenna 44 when a target 30 is present in the interrogation zone 24. As can be seen, the signal is dominated by the waveform of the alternating magnetic interrogation field from the transmitter antenna 42. This alternating magnetic field is at the transmitter or fundamental frequency of 218 HZ. The presence of the target 30 in the interrogation zone causes slight disturbances (P) of the magnetic field as a result of the target 30 being driven into and out of magnetic saturation twice during each cycle. A large portion of the signal produced by this alternating magnetic field at the fundamental frequency (218 HZ) is eliminated by the notch filter in the front end amplifier and filters 60. However, some remaining portion of this signal component is still present. The internal amplifier and band-pass filters 62 further attenuate the remaining portions of the fundamental frequency component as well as other components below the 10th harmonic and above the 17th harmonic of the fundamental frequency. Thus the output of the internal amplifier and band-pass filters 62 is made up of those frequency components which they pass, namely those components between 2,180 HZ and 3,706 HZ. While this is only a portion of the total spectrum of the frequency components of the pulses produced by the target 30, it has been found that this portion of the spectrum contains a sufficient amount of the components peculiar to the target 30. Accordingly the portion of the frequency spectrum between the 10th and the 17th harmonics of the fundamental frequency is well suited for accurate target discrimination.

The waveform (c) of FIG. 4 is an idealized representation of true target pulses with the frequency components below the 10th and above the 17th harmonics removed. However, the actual form of the pulses is more like that shown in the waveform (d) of FIG. 4. This is because the filtering produced by the circuits 60 and 62 causes the retained frequency components to become phase shifted with respect to each other. Thus, the resulting pulses are spread out in time. In one aspect of the invention this pulse spreading effect is compensated so that several closely spaced pulses can be separately analyzed.

In carrying out the present invention, the signals from the internal amplifier and bandpass circuits 62 are sampled at several instances during each transmitter cycle. It will be recognized that the more samples that are taken during each transmitter cycle, the closer the samples will follow the actual pulses resulting from the disturbances produced by the target 30. It has been found however that as long as the samples are taken at a rate which is greater than twice the frequency of the highest harmonic carried in the sample, the resulting sample composite will contain sufficient information to reproduce the pulses without any aliasing effects. In consideration of attenuation characteristics of the circuits 60 and 62, particularly the low pass filtering produced in the circuit 62, and in consideration of the resolution of the analog to digital converter 64 (e.g. twelve bits), a sampling rate of 64 times the fundamental frequency of 218 HZ is considered sufficient to avoid, for all practical purposes, the effects of aliasing.

Thus the signals produced by the target 30 occur at a first frequency, namely, twice the fundamental frequency of the transmitter, which in this embodiment is 218 HZ. The frequency components which are used to ascertain the distinctive characteristics of the target signals extend up to a second, higher, frequency, which in this illustrative embodiment is the 17th harmonic, namely 3,706 HZ. The attenuation provided by the filters in the system effectively eliminate, or at least reduce to below an appreciable level, all frequency components below a third, still higher frequency, which in this illustrative embodiment, is the 32nd harmonic, namely 6,976 HZ. To avoid aliasing, samples are taken at a frequency of at least twice the third frequency, namely, the 64th harmonic or 13,952 HZ.

As indicated in FIG. 3, there are provided as many noise blanker circuits 67 and signal averager circuits 68 as there are samples to be taken during each cycle; and each of these circuits is assigned to a corresponding sample interval. Thus, the sample clock multiplexer 66 has a single input terminal 66*a* at which the sample clock signal from the clock generator 50 is applied, and 64 outputs $66b_1 \ldots 66b_M$ each connected to a corresponding one of the noise blankers 67 and averager circuits 68. Thus the multiplexer 66 switches the clock signal on its common input terminal 66*a* to each of its output terminals $66b_1 \ldots 66b_M$ at a rate of $-13{,}952$ times per second or 64 time during each cycle of the fundamental interrogation frequency (218 HZ). Since an integral number (M) samples are taken during each cycle of the interrogation field and since the switching of the sample multiplexer 66 repeats after every M samples, and since each sample from the analog to digital converter 64 is made available to the noise blanker 67 in each of the M processors 65, each of the noise blankers 67 and signal averagers 68 operate on the sample associated with only an associated one of the M corresponding portions of successive magnetic field interrogation cycles.

In one aspect, the present invention eliminates signals which do not have a sufficient degree of consistency from cycle to cycle of the interrogation field. When a true target 30 passes through the interrogation zone 24 it produces pulses in corresponding portions of each interrogation field cycle. Since the interrogation field cycle is $218^{-1}$ seconds (0.0046 seconds), a true target, whose passage time when carried through the interrogation zone is about 1.5 seconds, would ideally experience about 326 interrogation cycles and may produce about that many pulses. Actually, magnetic nulls are encountered along most paths so that less than 326 interrogation cycles are capable of producing target responses. It has been found that if only three pulses occur in a sequence of three successive interrogation cycles and if those pulses all have quite similar amplitude, it is likely that they were produced by a true target passing through the interrogation zone and not by a passing spurious electromagnetic disturbance or by some other energy source which is not synchronous with the magnetic interrogation field. However, a greater number of pulses from a correspondingly greater number of cycles may be compared to provide an even finer degree of selectivity.

The processing of several signal samples from corresponding parts of several successive interrogation cycles to ascertain the presence of a true target is not new. What is new, among other things, is the fact that in this invention, the successive samples are not processed in a manner which merely gives a weighted sum of those signals. Instead in the present invention the successive samples are compared in a manner which takes into account their deviation from each other. In other words, the consistency of sample amplitude from cycle to cycle is used as a criterion to ascertain whether the signals are being produced by an object which has been energized by the transmitter as opposed to one whose exitation originated from an outside source not associated with the system. When only an arithmetic average is used, a very large spike in one cycle may be sufficient to raise the signal level for several cycles by an amount to indicate the presence of a target, even though a target may not be present. However if the deviation from cycle to cycle is taken into account then the very large spike can be discounted.

As specifically carried out, the present invention, in one aspect, processes the amplitudes of the samples taken at corresponding portions of N successive signal samples (for example, N=3 cycles), to ascertain whether the square of the sum of the sample amplitudes is greater than a predetermined constant $K_{th}$ (threshold constant), multiplied first by the same number of cycles, and multiplied further by the sum of the squares of the sample amplitudes. Typically, the constant $K_{th}$ has a value between 0 and 1 and may be supplied to the system in a manner which renders it field-adjustable. If the square of the sum of the sample amplitudes is greater, the system will allow the latest signal sample amplitude to pass through to the averagers for further processing, and at the same time will hold the value of the sample for comparison in the same manner with sample amplitudes which will be taken from corresponding portions of subsequent interrogation cycles. If the square of the sum of the sample amplitudes is less than the latter value, the system will not allow the sample amplitude to pass through to the averagers but it will hold the sample value for comparison in the same manner with sample amplitudes which will be taken from corresponding portions of subsequent interrogation cycles. Instead, it will feed back to the averagers the output of the long term averager for the selected sample interval.

Figure 5:
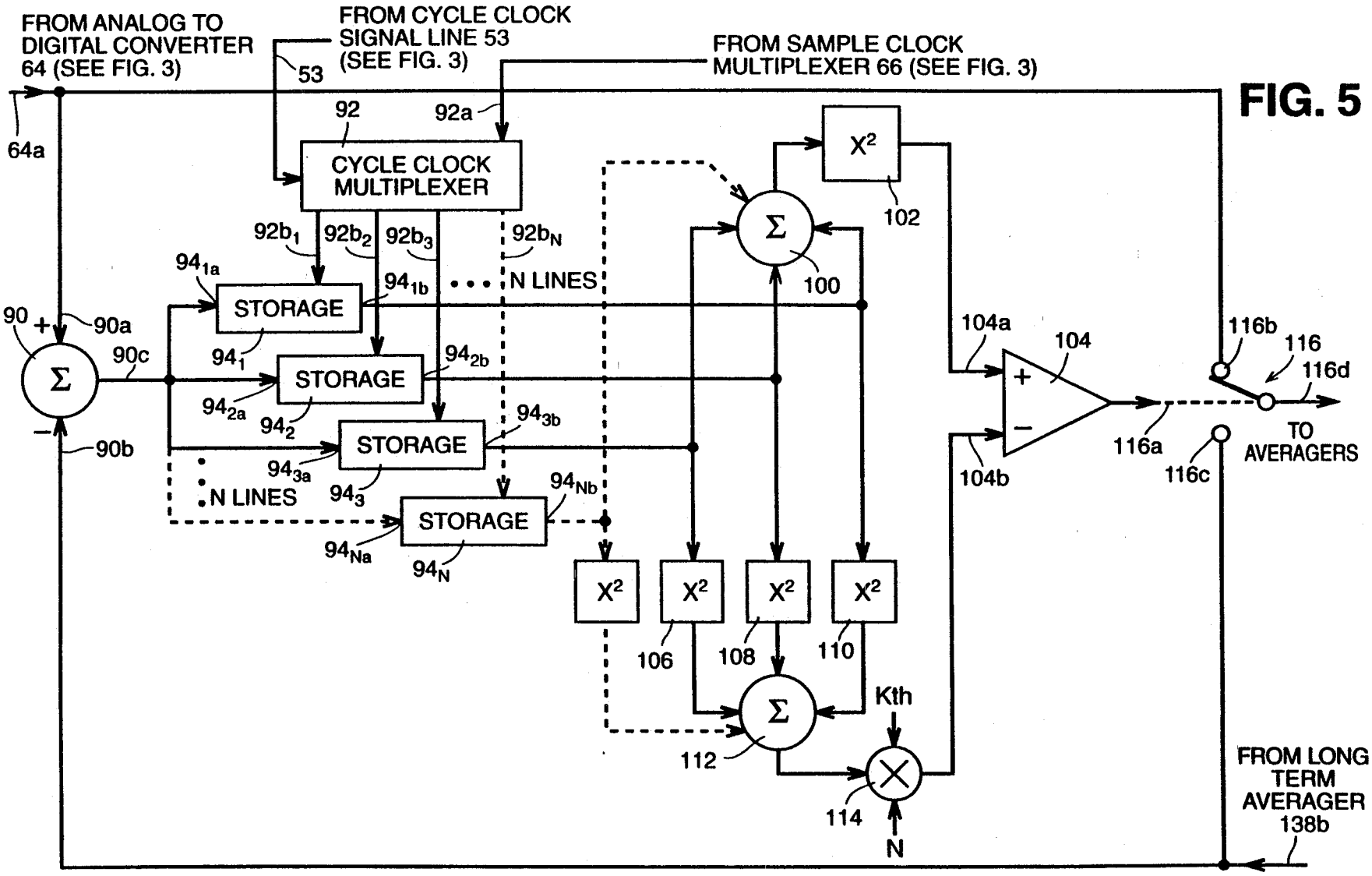
FIG. 5 is a further block diagram of a noise blanker portion of the system of FIG. 4.

The noise blanker block diagram of FIG. 5 shows the construction of the noise blanker 67 which makes the above described comparisons. As can be seen in FIG. 5, there is provided, for each of the noise blanker circuits 67, a summer 90 which, at one input terminal 90*a*, receives inputs from the analog to digital converter 64. The summer 90 also receives, at a second input terminal 90*b*, negative values of long term averager signals. The significance of these last mentioned long term averager signals will be described hereinafter. The summer 90 supplies its outputs to storage elements 94, $94_2$, $94_3$ (up to N such elements). Each element is activated by an output of the cycle clock multiplexer 92. The output of the sample clock multiplexer is connected to a common input terminal 92*a* of a cycle clock multiplexer 92. The cycle clock multiplexer 92 uses signals from the cycle clock signal line 53 to switch its sample clock multiplexer signal input terminal 92*a* to each of its output terminals $92b_1 \ldots 92b_N$ in succession, although, as mentioned above, sample amplitudes from only three successive cycles are taken in the present embodiment to obtain an indication as to whether any of them were produced by spurious or non synchronous energy. Therefore the cycle multiplexer 92 has three output terminals $92b_1$, $92b_2$ and $92b_3$. For certain applications it may be desired to provide a finer resolution of the distinction between spurious or non synchronous energy and synchronous energy. In such case a larger number N of output terminals up to $92b_N$ from the cycle clock multiplexer may be provided along with the associated additional elements shown connected by dashed lines.

It should be understood that the cycle clock multiplexer 92, like the sample multiplexer 66, recycles, so that the next cycle clock transition to occur after the multiplexer has been switched to its last output terminal, causes the multiplexer to be switched again to its first output terminal.

The output terminals $92b_1 \ldots 92b_N$ of the cycle clock multiplexer 92 are connected to associated signal devices $94_1$, $94_2$, $94_3 \ldots 94_N$. The storage devices are capable of holding the value of the sample last applied to their input terminal $94_{1a}$, $94_{2a}$, $94_{3a} \ldots 94_{na}$. This signal value appears continuously at the respective storage device's output terminal $94_{1b}$, $94_{2b}$, $94_{3b}$, $94_{nb}$. However, when the storage device's input terminals $94_{1a}$, $94_{2a}$, $94_{3a}, \ldots 94_{Na}$ become active, the old sample value in the storage device is replaced by the new value provided by the value at the summer output terminal 90c.

The sample values in the signal storage devices are applied continuously to a sample value summer 100 where they are combined arithmetically. The resulting arithmetic sum is then applied to a squaring circuit 102 which produces an output corresponding to the square of its input. The squaring circuit 102 thus produces an output corresponding to the square of the sum of the successive sample values. The output of the squaring circuit 102 is applied to a plus input terminal 104a of a comparison circuit 104.

The sample values in the signal storage devices $94_1$, $94_2$, $94_3 \ldots 94_N$ are also applied to individual squaring circuits 106, 108, 110, etc. which, respectively, produce output values corresponding to the square of the values of the signals applied to their input. The outputs of the squaring circuits 106, 108, 110, etc. are applied continuously to a sample squared summer circuit 112 which produces an output value corresponding to the arithmetic sum of its inputs. The output of the sample squared summer 112 is thus a value corresponding to the sum of the squares of the values stored in the storage devices $94_1$, $94_2$, $94_3 \ldots 94_N$.

The output of the sample squared summer 112 is applied to a multiplier circuit 114 where its value is multiplied by a number N, corresponding to the number of signal storage devices (in this embodiment, three), and by a preset value $K_{th}$, which represents the threshold of signal value consistency needed to prevent a pulse from passing to the averagers. Typically, $K_{th}$ varies from 0 to 1. The output of the multiplier circuit 114 is applied to a negative input terminal 104b of the comparator circuit 104.

The comparator circuit 104 is applied to a switch actuation terminal 116a of an inhibit switch 116. The inhibit switch 166 has a first signal input terminal 116b which is connected to receive the same signals which are applied from the analog to digital converter 64 to the input terminal 90a of the summer 90. The inhibit switch 116 also has a second signal input terminal 116c which is connected to receive signals from a long term averager to be described. When the output of the comparator circuit is more positive than negative, that is, when the square of the sums in the storage devices $94_1$, $94_2$, $94_3 \ldots 94_N$ is greater than the sum of the squares of those signals times N times $K_{th}$, its output causes a common terminal 116d of the switch 116 to be connected to its first signal input terminal 116b so that the common terminal 116d receives signals directly from the analog to digital converter 64. However, when the output of the comparator circuit is more negative than positive, its output causes the common terminal 116d of the switch 116 to be connected to its second signal input terminal 116c so that its common terminal receives signals only from the long term averager (to be described).

The signals from the analog to digital converter 64 which are applied to the noise blankers 67 are composite signals which include a first component of known periodicity, namely, the period separating alternate target produced responses, and a second component not of the known periodicity, namely, that resulting from other sources. The noise blankers compare the amplitudes of the composite signals from corresponding time intervals in each of a plurality of signal periods and operate their respective switches 116 to control the flow of the composite signals to further processing circuits, namely, the signal averagers 118 and 120, according to the degree of variation in those amplitudes. The components of known periodicity are closely similar to each other in amplitude from cycle to cycle; and if they predominate, the noise blanker will move the switch 116 to its upper position to pass the composite signal to the further processing circuits. If, however, the components which are not of the known periodicity predominate, they will not be similar in amplitude from cycle to cycle and the noise blanker will move the switch 166 to its lower position so that the composite signals will not pass to the averager circuits 118 and 120.

Figure 6:
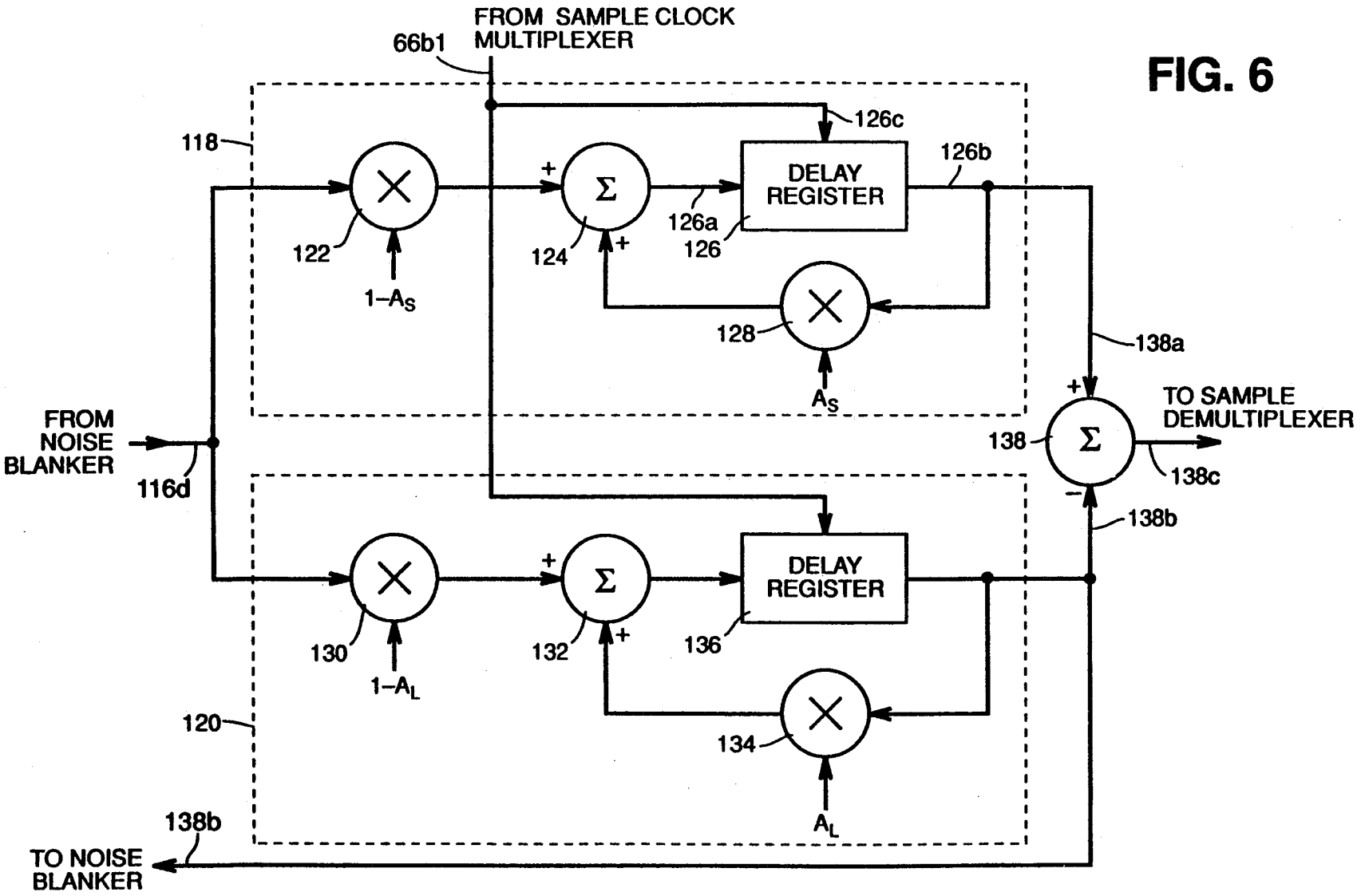
FIG. 6 is a block diagram of long and short term averagers used in the system of FIG. 1.

The common terminal 116d of the switch 116 in the noise blanker circuit 67 is connected, as shown in FIG. 6, to both a short term averager 118 and a long term averager 120. The short term averager 118 includes a first multiplier 122, a summer 124, a delay register 126 and a second multiplier 128. The first multiplier 122 is connected to receive signals passed by the noise blanker circuit via the common switch terminal 116d and to multiply them by a preset value $(1-A_S)$. The output of the first multiplier 122 is applied to the summer 124 which adds it to a value from the second multiplier 128. The sum of these values is applied to an input terminal 126a of the delay register 126 which stores them and maintains the summed value at an output terminal 126b until it receives a pulse from the sample clock multiplexer terminal 66b, which is dedicated to it. Because of the sample clock multiplexer logic, each output is activated for only one sample interval per cycle. Each averager is thus dedicated to a specific one of M sample intervals and is updated only during that one interval in each cycle. The output from the delay register 126 is applied to the second multiplier 128 where it is multiplied by a preset value $(A_S)$. The multiplied value is then applied to the summer 124.

In operation of the short term averager 118, signal values applied to the first multiplier 122 from the noise blanker circuit 67 are multiplied by $(1-A_S)$ in the first multiplier 122, summed in the summer 124 with the output of the second multiplier 128, delayed in the delay register 126 and multiplied by the value ($A_S$) in the second multiplier 128. The output is then recycled through the summer 124, the delay register 126 and the second multiplier 128. This produces, at the output of the delay register 126, an output which is a weighted sum of the values of the previous input signals from the noise blanker circuit 67. The value of the each previous input signal diminishes in the short term averager 118 according to the number of times it circulates through the averager and according to the value of $A_S$. If A were zero then each previous input signal would go to zero on its first recirculation and the value of the present input from the noise blanker circuit would be the new output. This is the shortest possible averaging. However, as the value of As increases, the previous input signal values have greater influence and the averaging period becomes longer.

The long term averager 120 is of the same construction as the short term averager 118, and like the short term averager, the long term averager 120 comprises a first multiplier 130 which receives signals from the noise blanker circuit 67 and multiplies them by a preset value, which in this case is designated $(1-A_L)$. The resulting value is added in a summer 132 with an output value from a second multiplier 134 and the summed value is applied to a delay register 136. The delayed output from the delay register 136 is multiplied by a preset value $A_L$ and applied to the summer 132.

The only difference between the long and short term averagers 118 and 120 is the value of A. The value of $A_L$ in the long term averager 120 is greater than the value of $A_S$ in the short term averager 118 so that the long term averager takes into account a longer duration of past signal values in producing an output value. As mentioned above, the output from the sample clock multiplexer **66*b***, which is dedicated to this averager causes the output to be updated over every M sample interval.

The output of the short term averager 118 is taken from the output of its delay register 126 and is applied to a plus input terminal **138*a* of an averager summing circuit 138. At the same time, the output of the long term averager 120 is taken from the output of its delay register 136 and is applied to a minus input terminal 138*b* of the averager summing circuit 138. The output of the averager summing circuit 138 is taken from an output terminal 138*c* and is applied to a corresponding input terminal $70a_1 \ldots 70_aM$ of the sample demultiplexer 70 (FIG. 3). The output of the long term averager 120 is also applied to the negative input terminal 90*b* of the summer 90 in the noise blanking circuit 67 (FIG. 5**).

As mentioned above, the noise blanking circuits 67 operate to prevent passage of any signals unless the values of at least three successive pulses applied thereto have a certain minimum variation. This will tend to block non-synchronous energy, that is energy which does not vary in synchronism with the transmitter. However, there are at times, other non target energy sources nearby which, for periods of three or more successive pulses, vary only minimally but which have a low average value over the period of the associated short term averager 118. That is, they do not persist as long as a signal from a target but while they do occur they may possibly not vary substantially from pulse to pulse. The signals produced by these energy sources are attenuated by both averagers 118 and 120.

The difference of the outputs from the signal averagers 118 and 120 eliminates the effects of unvarying non-target synchronous energy sources, such as are produced by metal objects in the range of the transmitted magnetic fields or are produced internally by the circuit elements which operate synchronously with the transmitter. The average value of this unvarying energy is measured in each long term averager 120 and is subtracted from the output value of the corresponding short term averager 118 in the averager summing circuit 138. Since both averagers contain identical estimates of these unvarying energy sources, those signals are cancelled at the output of the differential summer 138.

The outputs of the long term averagers 120, as mentioned above, are applied to the negative input terminal **90*b* of the summer 90 in their associated noise blanking circuits 67**. The purpose for this is to keep the noise blanking circuits sensitive to variations in the pulse to pulse signal values. If the signal values of successive pulses vary by a given amount, that amount will be quite significant if the total signal value of each pulse is small. But if each pulse is added to the same large amount, for example from a non target energy source, then that same variation between the successive pulses will become relatively less significant. Therefore, by subtracting from the incoming pulses, the long term average value of the energy in the associated sample interval, the pulse to pulse variation is made more significant.

The outputs from each of the averager summing circuits 138 are combined in the sample demultiplexer 70 (FIG. 3). Each of the averager summing circuit output terminals **138*c* are connected to a corresponding input terminal $70a_1 \ldots 70aM$ of the demultiplexer 70. The demultiplexer 70 has a switch actuation terminal 70*b* connected to receive pulses from the sample clock signal line 51. These pulses cause the input terminals $70a_1 \ldots 70a_M$ to be switched, in sequence, to a common output terminal 71. Thus the signals from the analog to digital converter, which were divided into time increments by pulses from the clock generator 50, and separately processed in the noise blankers and averagers, are reconstructed in the sample demultiplexer 70**.

By way of further explanation, in the transmitter portion of the system, the clock generator 50 produces a signal whose frequency is $D^*F_0$, where D is an integer and $F_0$ a frequency in hertz. This signal is divide by the dividers 52 to produce a signal of $F_0$ hertz. The $F_0$ hertz signal is then further processed, amplified and applied to the transmitter antenna 42 to create a field capable of exciting the target 30. The sole restriction on the method of processing $F_0$ is that the resulting transmitter field excites the target in such a manner as to produce a response which is periodic in $F_0$.

In the receiver, the receiver antenna 42, which is capable of sensing the presence of the target 30, is coupled through a series of filters and amplifiers which enhance the ratio of target signal energy to non-target signal energy. The accordingly enhanced output of these elements is presented to the analog to digital converter 64. The analog to digital converter generates sample signals at a rate of $D^*F_0$, where the $D^*F_0$ signal is either obtained or derived from the system transmitter or independently generated in such a manner that the transmitter and receiver versions are identical in frequency. It should be noted that there are no restrictions on the phase relationship between these signals. The digital conversions of the analog to digital converter are presented to a functional block which includes a processor capable of performing digital signal processing functions at high speeds. The processor processes the signals applied to it in a manner which produces a condition representative of the presence of target, and activates the alarm 48 under that condition.

The purpose of the noise blanking circuits is to distinguish between energy which is not a result of the transmitter's $F_0$-based signal and which therefore is non system-synchronous, and that which is system-synchronous, with a view toward blocking the former from passing further in the signal processing chain. It does this by dividing the $F_0$ cycle into D time slots and making use of the fact that system-synchronous energy appears repeatedly in the same slot or slots, while non system-synchronous noise does not and is randomly spaced in time.

It is important to distinguish between transient synchronous noise, such as that which occurs when targets or "innocent" objects are carried through the system, and stationary synchronous noise, which is always present. The latter is generally the result of spurious energy coupled from the transmitter to the receiver and of objects permanently mounted near the system's active region and responsive to the transmitter field. The following is a simplified description of the noise blanker algorithm in which the possible presence of stationary synchronous noise is ignored. The complete noise blanker algorithm, in which the presence of possible stationary synchronous noise is present, will be given later.

In the system, N cycles of analog to digital conversions are stored in memory, there being D samples in every cycle. A sample in the d(th) slot of the n(th) cycle can be referred to as $s_{nd}$. A software pointer advances through each cycle, one time slot at a time. When it reaches the Dth slot in a cycle, it advances to the next cycle. At the end of the Nth cycle, the pointer returns to the first slot of the first cycle. The pointer moves at a rate of $D*F_0$, once for every analog to digital conversion.

As the pointer moves to the next slot, the algorithm proceeds by computing the ratio of the square of the sum of all the samples of column d to N times the sum of the squares of the column d samples. Mathematically, this is written as:

$$\frac{\left(\sum_{n=1}^{N} s_{nd}\right)^2}{N \times \sum_{n=1}^{n} s_{nd}^2} = K \qquad \text{I.}$$

The value K can be seen to be a measure of how similar the sample values are within a column. The more similar, the higher the value of K, corresponding to a system-synchronous signal. It can be seen, for instance, that if all sample values within the current column are identical, then K=1. If, however, the samples differ, and their average value is 0, then K=0. By evaluating the above equation and determining whether K is greater than a given threshold $K_{th}$, the algorithm determines whether the single sample being pointed to is synchronous, and therefore should be passed on for further examination, or non-synchronous, whereby it is deemed noise and unworthy of further processing.

In practice, it is simpler to avoid division and evaluate the computationally equivalent problem:

$$\left(\sum_{n=1}^{N} s_{nd}\right)^2 \geqq K_{th} \times N \times \sum_{n=1}^{N} s_{nd}^2 \qquad \text{II.}$$

The above would be sufficient if it were not for the existence of stationary synchronous energy in real systems. This energy manifests itself by adding to each sample a component of energy which does not change with cycle n, but rather is constant within a column d. This background energy necessitates the modification of the above equations.

In order to properly account for this term, it is necessary to first develop an estimate of it. Such an estimate may be obtained through the use of a synchronous filter or averager.

A synchronous filter (synchronous with $D*F_0$, that is) can be developed by dividing the $F_0$ cycle up into D time slots, there being a one to one correspondence between each averager slot and each column of slots developed in the simplified noise blanker algorithm. As the sample pointer detailed above advances from slot to slot, a separate pointer to the averager advances with it in lockstep. However, when the simplified noise blanker algorithm pointer advances to the first sample of the next cycle, the averager pointer merely returns to the first sample of the averager.

Before detailing how the averager works in conjunction with the noise blanker algorithm, operation of the averager as a stand alone device will be described. Each output sample $a_d$ of a stand alone is averager is combined with an input $x_d$ and is modified according to the following equation:

$$a_d \leftarrow a_d \times \alpha + x_d \times (1-\alpha) \qquad \text{III}$$

where alpha is a constant between 0 and 1 which establishes the time constant of the filter.

The averager thus acts to produce for each time slot an average of the energy incident upon each of its D cells.

It should be noted here that the averager input $x_d$ is in fact the output of a modified version of the noise blanker algorithm which takes into account the averager output state. The following set of equations describes the output $y_d$ of the full noise blanker algorithm for the arbitrary time where all pointers are in column d:

$$M_d \leftarrow \left(\sum_{n=1}^{N} (s_{nd} - a_d)\right)^2 \qquad \text{IV.}$$

$$V_d \leftarrow N \times \sum_{n=1}^{N} (s_{nd} - a_d)^2 \qquad \text{V.}$$

$$M_d - K_{th} \times V_d \qquad \text{VI.}$$

If the above difference is positive, then:

$$y_d \leftarrow s_{nd} \qquad \text{VII}$$

$$a_d \leftarrow a_d \times \alpha + x_d \times (1-\alpha) \qquad \text{VIII}$$

If the difference is negative, then:

$$y_d \leftarrow a_d \qquad \text{IX}$$

and $a_d \leftarrow a_d$ X

Figure 7:
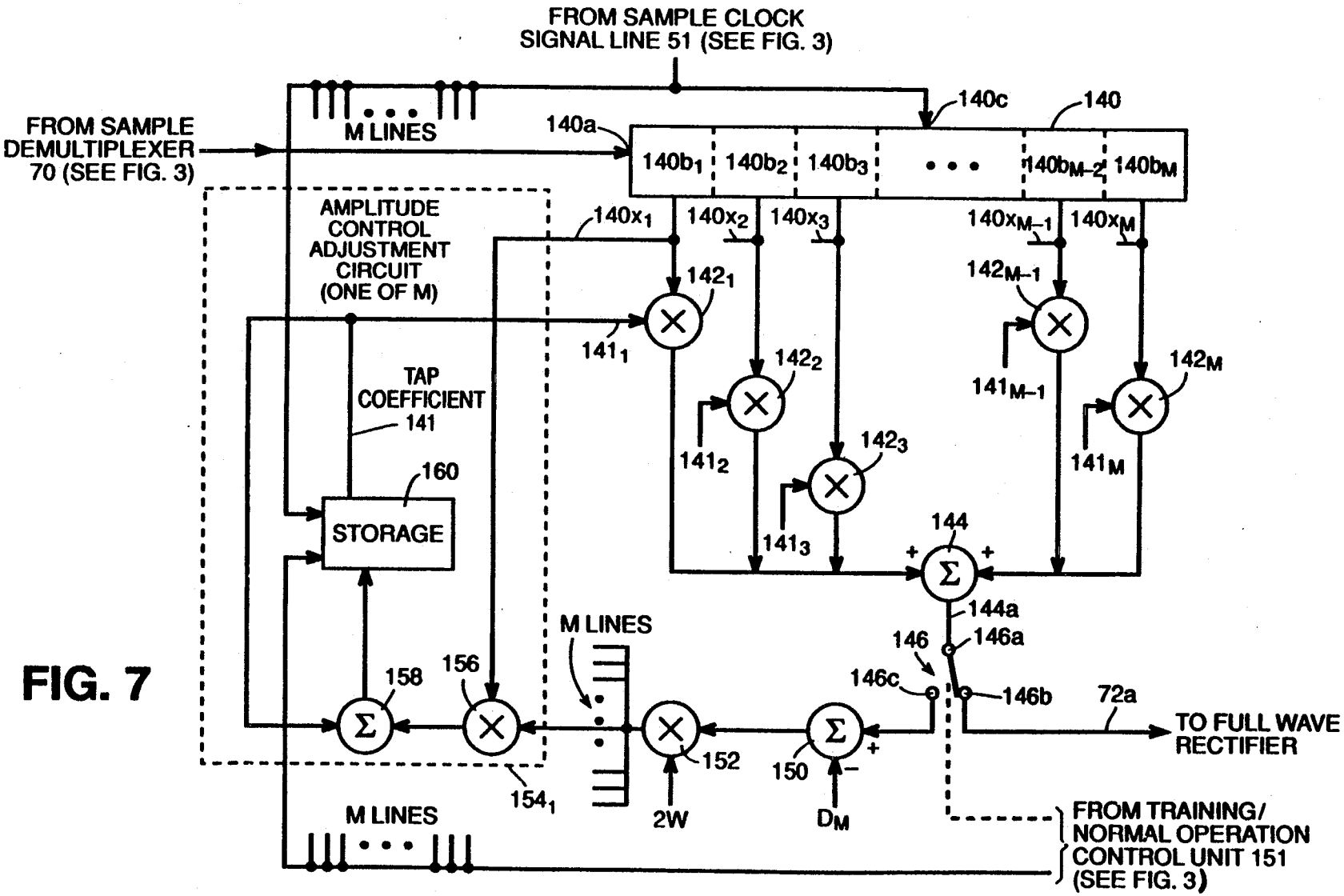
FIG. 7 is a further block diagram of a pulse straightener portion of the system of FIG. 3.

The signals from the common output terminal 71 of the demultiplexer 70 are applied to the adaptive equalizer 72 which is shown in more detail in FIG. 7. Here again it should be understood that while the adaptive equalizer is shown in block diagram in FIG. 7, this is for purposes of illustration; and the actual device is formed as part of an integrated circuit.

As shown in FIG. 7, the adaptive equalizer 72 includes a delay line register 140 which receives signals at an input terminal 140*a* from the output terminal 71 of the sample demultiplexer 70. The delay line register 140 has a series of cells 140$b_1$ . . . . 140$b_M$; and the signals applied at the input terminal 140*a* at one end of the register 140 pass through each of the cells in step by step sequence as clock pulses are applied from the sample clock signal line 51 (FIG. 3) to a clock pulse terminal 140*c*. The delay line register 140 should have a total length or delay period equal to the period of the fundamental frequency, namely the frequency of the interrogation magnetic field; and the number of cells 140*b* should be equal to the number of pulses M applied to the terminal 140*c* during such period. Thus the delay line register 140 contains, at any instant, the signal pulses which have passed through the noise blankers and averagers during one cycle of magnetic interrogation field variation.

Each cell in the delay line register 140 has a tap output 140$x_1$ . . . . 140$x_M$ which is connected to an associated output multiplier 142$_1$ . . . 142$_M$. These multipliers 142 accept as inputs, signals from associated tap coefficient lines 141$_1$ . . . 141$_M$. Those signals are generated by the M amplitude control adjustment circuits 154$_1$ . . . 154$_M$ only one of which, 154$_1$ is shown. The outputs of the multipliers 142$_1$ . . . 142$_M$ are combined in a summing circuit 144. The summing circuit 144 has a common output terminal 144*a* which is connected to a common terminal 146*a* of a second training/operation switch 146. One output terminal 146*b* of the training/operation switch 146 is connected to the full wave rectifier 73 (FIG. 3). Another output terminal 146*c* of the training/operation switch 146 is connected to a plus input terminal of a summing circuit 150. An idealized pulse signal $D_M$, from an internal source (not shown) is applied to a negative terminal of the summing circuit 150.

It has been found that a delta function which consists of a signal with a single non-zero value in one of M sample intervals and a value of zero elsewhere is not itself a useable signal for this application. For a delta function to be useful, frequency components which have already been filtered out by the filters 62 would have had to be present. Instead, it has been found that a useful signal may be obtained by sampling a signal of the shape shown in FIG. 4*c*. In the present embodiment, nine of the M samples (M=64) in this sequence are non-zero and correspond to the pulse shown. This produces a significant improvement in the shape of the pulse over that which exits from the filters 62, as shown in FIG. 4*d*. When the second training/operation switch 146 is in the train position (that is, when the common terminal 146*a* is connected to the second output terminal 146*c*), the summing circuit 150 subtracts the value of the idealized pulse signal from the value of the signal in the summing circuit 144. The resulting signal, which represents an error value, is applied to a multiplier 152, which multiplies it with a coefficient 2W. By choosing a large value for W it becomes possible to achieve rapid convergence or adaptation of the adaptive equalizer 72. However, the precision of adjustment is low in such case. On the other hand, by choosing a small value for W, the precision of adjustment is increased but the speed at which it occurs is reduced. It is beneficial to provide a value of W which varies with the amount by which the adaptive equalizer deviates from the ideal setting. Then, for large deviations, the adjustments will be large and rapid, and as the amount of deviation decreases, the resulting value is applied to each of several individual amplitude control adjustment circuits 154$_1$ . . . 154$_M$ associated with each of the cells in the delay line register 140. For purposes of clarity of explanation only one of the amplitude control adjustment circuits 154$_1$ is described in connection with FIG. 7. However, the construction and operation of the others is the same.

As shown in FIG. 7, the amplitude control adjustment circuits 154 each comprise a multiplier 156, an adder 158 and a delay register 160. The multiplier 156 is connected to receive and multiply the value of the output from the multiplier 152 with the value of the output signal 140*x* from an associated delay register cell 140*b*. The resulting value is added in the adder 158 to the tap coefficient 141 which was developed during the time of the preceding input from the clock pulse generator 50. The output from the adder 158 is supplied to the storage register 160 where it is delayed for a duration equal to one sample interval, namely, the pulse period of the sample clock signal line 51. The output of the storage register is the tap coefficient 141 and is applied to the associated multiplier 142.

As mentioned above, when the second training/operation switch 146 is switched to its operation position, namely with the common terminal 146*a* connected to the second output terminal 146*b*, the output signals from the adaptive equalizer are supplied through a full wave rectifier to the signal and noise channels 74 and 80. These signals can pass through the respective channels only at alternate times and only when the signal and noise channel gates 76 and 82 are opened. These gates are opened by outputs from the gate generator 88 which in turn receives pulses from the divider 52 (FIG. 3). The gate generator 88 is set so that it opens the signal gate 76 during that portion of the magnetic interrogation wave cycle within which pulses from true targets are likely to occur, that is, when the magnetic field is close to being changed in direction and is at relatively low intensity. The gate generator 88 opens the noise gate 82 when the magnetic interrogation field is in the portions of its cycle where it has a high intensity, namely, an intensity beyond that at which a true target would produce pulses.

The signals which pass through the signal gate 76 are applied to the low pass filter 78 which provides smoothing. The smoothed signals are then applied to the plus input terminal of the comparator 86. Meanwhile the signals which pass through the noise gate 80 are applied to the peak detector 84 which produces an output along the noise channel 80 corresponding to the value of the signal which occurred while the noise gate 82 was last opened. This noise signal value is applied to the minus terminal of the comparator 86. The comparator 86 will produce an alarm output when the value of the filtered signal in the signal channel 74 is greater than the value of the signal in the noise channel 80. The alarm output is then applied to actuate the alarm 48.

Operation of the above described system occurs in two modes, namely, a training mode and an operation mode. The purpose of the training mode is to preset the amplitude control adjustment circuits 154 and the signals on the associated tap coefficient lines $141_1 \ldots 141_M$ in the adaptive equalizer 72. This training mode occurs for a period of about 15 seconds when the system is first turned on. During this time the training/normal operation control unit 151 switches the first and second training/operation switches 61 and 146 to their training position, which allows the storage elements 160 to be updated at each sample interval. That is, the first switch 61 is set to connect the output of the test pulse generator 63 to the amplifier and bandpass filters 62 (FIG. 3) and the second switch 146 is set to connect the output of the adaptive equalizer summing circuit 144 to the summing circuit 150 (FIG. 7). After this training has been concluded the unit 151 returns the movable element of the switch 61 (FIG. 3) to the input terminal 61*a* and the movable element of the switch 146 (FIG. 7) to its output terminal 146*b*. It also sends a signal to the storage registers 160 to prevent them from being further updated; and the registers hold their present value.

The purpose for the training mode is to set the adjustable tap coefficients in the adaptive equalizer 72 so that the adaptive equalizer will compensate for the phase distortion that occurs during the passage of signals through the amplifier and bandpass filters 62. As mentioned previously, these circuits remove frequency components outside a frequency range which is used to ascertain the distinctive characteristics of target produced pulses. This enables the pulses to be sampled and processed digitally; provided however, that they are sampled at a frequency at least twice the highest frequency passed by the amplifier and bandpass filters 62. In filtering out the high and low frequency components however, the filters also shift the relative phases of the signal components that they do pass. The adaptive equalizer 72, when its tap coefficients are properly set, compensates for this phase shifting. The setting of these adjustable amplitude control devices is carried out during the training mode, namely for the first fifteen or so seconds after the system is turned on and while the first training/operation switch 61 is set to connect the output of the test pulse generator 63 to the amplifier and bandpass filters 62 and while the second training/operation switch 146 is set to connect the output of the summing circuit 144 in the adaptive equalizer 72 to the summing circuit 150 and the following amplitude control adjustment circuits 154 and while the storage registers 160 are being updated in each sample interval.

The adaptive equalizer 72 operates in the manner of a finite response (FIR) or transversal filter having a tapped delay line with taps that are variously weighted and summed to produce an output. The setting of these taps is accomplished by interactively adjusting them according to a stochastic gradient algorithm to correct signals supplied from the test pulse generator 63 and bring them into conformity with a stored idealized pulse $D_M$ with minimal phase distortion. The idealized pulse $D_M$ is supplied from a pulse generator (not shown) and applied to the negative input terminal of the summing circuit 150 (FIG. 7) where it is algebraically combined with the output of the summing circuit 144 to generate an error signal. The error signal is scaled in the multiplier 152 and then supplied to each of the amplifier control adjustment circuits 154. Each amplifier adjustment control circuit multiplies the value of the modified error signal with the value of the signal from its associated tap output $140_x$ and, in the adder 158, adds the result to the tap coefficient value 141 obtained during the last sample interval. The output of the adder 158 is then stored in the storage register 160 for one sample period, namely, the pulse period of the clock generator 50, for use in the next operation. Meanwhile, the result from the previous sample, which is at the output of the storage register 160, is applied to the associated multiplier 142 and adjusts its amplification or attenuation by a predetermined increment. By repetitively sampling, comparing and adjusting, as above described for a period of several seconds, the several multipliers 142 are set to compensate for the effects of phase shifting produced by the amplifier and bandpass filter circuits 62. The tap coefficients then remain at their respective settings thereafter while the system is switched to its normal mode of operation by changing the setting of the first and second training/operation switches 61 and 146 to their respective normal operation settings and precluding the storage registers 160 from further modification.

The switches 61 and 146 may be operated by the preprogrammed control circuit 151 shown in FIG. 3.

It should be understood that the general idea of use of a delay line or delay register with multiple taps and adjustable tap coefficients to reshape a pulse signal is known. However, the adaptation of such general technique to the detection of signals from targets in electronic article surveillance is believed to be novel. Similarly, the use of signal averages which give weighted averages of pulse signals in electronic theft detection is known but the incorporation of signal averages with a noise blanking arrangement as herein described is believed to be novel.

There has thus been described a novel system for detecting the presence of targets in an interrogation zone and in the presence of non-target produced electrical and electromagnetic energy. In addition, the system automatically compensates for the effects of filtering on the phase relationships of different frequency components of the portions of the signals being analyzed in the system. It should be understood however, that the noise blanker circuits 67, both alone and in combination with either or both the long term and the short term averager, and the adaptive equalizer circuit 72, with its automatic adjustment feature are themselves separately novel and could be used in other applications.

The following APPENDIX contains a source code for programming microchips to carry out the above-described operations.

APPENDIX

```
addr    inst    source line

                1   {
                2   ADSP-2105 based MM-3000 System, 218Hz or 875Hz, Boot Page 0
                3   Serial Port 1 is used for Analog I/O, external clock & strobe
                4   Serial Port 0 not available on ADSP-2105
                5   Double Precision Averager Version
                6   10.000MHz clock
                7   }
                8
                9   .module/boot=0/abs=0x0000 mm3000_startup;
               10   .pagelength 55;
               11
               12   {       *** Define Some Constants ***      }
               13
               14   #ifdef std
               15
               16   .const imp_lo_lim = 2155;              {218Hz impulse energy lower limit}
               17   .const imp_hi_lim = 8620;              {218Hz "            " limit}
               18   .const offset_lim = 1092;              { 100mV/3V * 32768 }
               19   .const stavg_tc = 800;                 {averager TC's}
               20   .const ltavg_tc = 320;                 {... }
               21   .const gain = 0;                       {no frontend gain with DP averagers}
               22   .const frtend = b#1 | (gain<<4);
               23
               24   #endif
               25
               26   #ifdef mini11
               27
               28   .const imp_lo_lim = 2155;              {218Hz impulse energy lower limit}
               29   .const imp_hi_lim = 8620;              {218Hz "            " limit}
               30   .const offset_lim = 1092;              { 100mV/3V * 32768 }
               31   .const stavg_tc = 800;                 {averager TC's}
               32   .const ltavg_tc = 320;                 {... }
               33   .const gain = 1;                       {+6dB with shields  }
               34   .const frtend = b#1 | (gain<<4);
               35
               36   #endif
               37
               38
               39
               40   {       *** Data Memory Variables ***       }
               41
               42   .external long_avg;
               43   .external shrt_avg;
               44   .external nb_bufr;
               45   .external sample_cnt;
               46   .external txlevl;
               47   .external tmr_flg;
               48   .external sample;
               49   .external almsml;
               50   .external out_img;
               51   .external txctl_tmr;
               52   .external aux_tmr;
               53   .external bfw;
               54   .external avg_shrt;
               55   .external avg_long;
               56
               57
               58
```

```
                59   {       *** I/O Port declaration  ***      }
                60
                61   .port mailbox;          {inter-processor mailbox (d0-d7)}
                62   .port par_port;         {general purpose parallel I/O port}
                63
                64   .port hndshk_out;       {d0 = handshake lead to microcntrlr}
                65   .port txlv10;           {"  " lsb of tx sine level}
                66   .port txlv11;           {"  " msb of tx sine level}
                67   .port reset_micro;      {"  " reset to microcntrl}
                68   .port led_a;            {"  " red LED cathode, green LED anode}
                69   .port led_b;            {"  " red LED anode, green LED cathode}
                70   .port lamp;             {"  " alarm lamp enable }
                71   .port buzzer;           {"  " alarm buzzer enable }
                72   .port pet_dog;          {read this to reset the watchdog timer}
                73
                74
                75   {       !!! !!! !!! code starts here !!! !!! !!!      }
                76
                77           { --- interrupt vectors --- }
                78
0000   180C0Fu   79           jump cold;                    {hardware reset location}
0001   000000   80           nop;nop;nop;                  {skip 3 locations}
0002   000000
0003   000000
                81
0004   0A001F   82           rti;nop;nop;nop;              {external IRQ2 tied to f0, not used}
0005   000000
0006   000000
0007   000000
                83
0008   0A001F   84           rti;nop;nop;nop;              {SPORT 0 Tx not supported on 2105}
0009   000000
000A   000000
000B   000000
                85
000C   0A001F   86           rti;nop;nop;nop;              {SPORT 0 Rx not supported on 2105}
000D   000000
000E   000000
000F   000000
                87
0010   0A001F   88           rti;nop;nop;nop;              {SPORT 1 Tx, dual 8bit D>A, not used}
0011   000000
0012   000000
0013   000000
                89
0014   18000Fu   90           jump atod_int;                {SPORT 1 Rx, 12 bit A to D}
0015   000000   91           nop;nop;nop;                  {skip 3 locations}
0016   000000
0017   000000
                92
                93
                94   {       timer interrupt ...      }
                95
0018   0C0030   96           ena sec_reg;                  {select the secondary register set}
0019   40000A   97           ar = 0x0000;                  {clear the timer flag }
001A   90000Au  98           dm(tmr_flg) = ar;             {...}
001B   80000Au  99           ar = dm(pet_dog);             {kick the dog...}
001C   0C0020   100          dis sec_reg;                  {back to the main register set }
001D   0A001F   101          rti;                          {done, exit }
                102
                103
                104  { --- Cold boot code starts here --- }
```

```
                105
                106   cold:
001E    0C0C00  107          ena ar_sat;                    {let the "ar" reg sat, not ovrflw}
                108
001F    340004  109          m0 = 0;                        {setup null address modifier}
0020    340015  110          m1 = 1;                        {... increment address modifier}
0021    340026  111          m2 = 2;
0022    37FFF7  112          m3 = -1;
0023    380004  113          m4 = 0;
0024    380015  114          m5 = 1;
0025    380026  115          m6 = 2;
0026    380407  116          m7 = 64;
                117
0027    380009  118          i5 = 0;
                119
                120   { --- set all data ram to 0x0000 --- }
                121
0028    388001  122          i5 = 0x3800;                   {point to the start of data ram}
0029    3C2005  123          cntr = 512;                    {number of data ram locations}
002A    14000EU 124          do ram_0 until ce;             {do it}
002B    B00005  125   ram_0:  dm(i5,m5) = 0x0000;           {...}
                126
                127
                128
                129   { --- Initialize the on-chip peripherals --- }
                130
002C    43CCFA  131          ar = b#0011110011001111;       {SPORT 1 control register}
002D    93FF2A  132          dm(0x3ff2) = ar;               {...}
002E    40063A  133          ar = 55;                       {set timer prescale to div by 100}
002F    93FFBA  134          dm(0x3ffb) = ar;               {...}
0030    403E7A  135          ar = 999;                      {set timer to divide by 1000}
0031    93FFDA  136          dm(0x3ffd) = ar;               {...to give 10mS interrupts}
0032    93FFCA  137          dm(0x3ffc) = ar;               {...}
0033    400C1A  138          ar = b#0000000000000001;       {1 external data memory wait state}
0034    93FFEA  139          dm(0x3ffe) = ar;               {...}
0035    4DC1FA  140          ar = b#0000110000011111;       {enable SPORT1, no more boots}
0035    93FFFA  141          dm(0x3fff) = ar;               {...}
                142
                143
                144   { --- default load all of the DSP parallel output bits --- }
                145
0037    40081A  146          ar = b#10000001;               {select front end input with no gain}
0038    90000Au 147          dm(par_port) = ar;             {write it out to the parallel port}
                148
0039    40001A  149          ar = 1;
003A    90000Au 150          dm(hndshk_out) = ar;           {set the handshake lead high}
                151
003B    40000A  152          ar = 0;                        {Set tx level to 00% }
003C    90000Au 153          dm(txlevl) = ar;               {...}
003D    90000Au 154          dm(txlvl0) = ar;               {...}
003E    90000Au 155          dm(txlvl1) = ar;               {...}
                156
003F    40080A  157          ar = 0x80;                     {setup the alarm fail sample words}
0040    90000Au 158          dm(almsm1) = ar;               {...}
                159
0041    400FAA  160          ar = 250;                      {don't check tx levels for 2.5 Sec }
0042    90000Au 161          dm(txctl_tmr) = ar;            {... }
                162
                163   { --- setup all of the DAG's (Data Address Generators) ---}
                164
0043    340000u 165          i0 = ^shrt_avg;                {shrt term avgr used to store ideal}
0044    340001u 166          i1 = ^long_avg;                {point to long term avgrs}
```

```
0045   340002   167          i2 = 0x0000;                    {gen purp interrupt task index reg}
0046   340003   168          i3 = 0x0000;                    {"                                 "}
                169
0047   380000   170          i4 = 0x0000;                    {gen purp backround task index reg}
0048   380001   171          i5 = 0x0000;                    {"                                 "}
0049   380002   172          i6 = 0x00C0;                    {"                                 "}
004A   380003u  173          i7 = ^nb_bufr;                  {...middle of noise blanker buffer}
                174
004B   340808   175          l0 = 128;                       {the number of short term avg taps}
004C   340809   176          l1 = 128;                       {"          " long  "             "}
004D   34000A   177          l2 = 0;                         {general purpose pointers}
004E   34000B   178          l3 = 0;                         {"                        "}
                179
004F   380008   180          l4 = 0;                         {general purpose pointers}
0050   380009   181          l5 = 0;                         {... }
0051   38000A   182          l6 = 0;                         {... }
0052   38080B   183          l7 = 128;                       {noise blanker is 128 words long}
                184
                185
                186  {        Wait here for the falling edge of F0        }
                187
0053   3C0044   188          icntl = b#0010C;                {no int nesting, IRQ2 edge triggered}
0054   3C0203   189          imask = b#100000;               {enable IRQ2 interrupts}
0055   028000   190          idle;                           {wait for an F0 edge}
0056   028000   191  frm0wt: idle;                           {...and the next one}
0057   800000u  192          ax0 = dm(par_port);             {wait for frame 0}
0058   400074   193          ay0 = 7;                        {...}
0059   23800F   194          ar = ax0 and ay0;               {...}
005A   180001u  195          if ne jump frm0wt;              {...}
005B   3C002C   196          ifc = b#000000000010;           {force clear any pending SPORT1 Rx int}
005C   000000   197          nop;
005D   3C002C   198          ifc = b#000000000010;
                199
                200
                201  { --- Setup, then enable Interrupts --- }
                202
005E   3C0033   203          imask = b#000011;               {enable timer and SPORT1 Rx interrupts}
005F   0CC000   204          ena timer;                      {turn on the timer}
                205
                206
                207  {-------------------------------------------------------}
                208  { ***     Initialization Processing Routine        *** }
                209  {-------------------------------------------------------}
                210
                211  main:
                212
                213  {        ...let the long term averager settle for 5 seconds     }
                214
0060   401F44   215          ay0 = 500;                      {wait 5 Sec...}
0061   1C000Fu  216          call delay;                     {...}
                217
                218
                219  {        check the energy in the long term averager     }
                220
                221  {        ...find the DC offset of the input sequence    }
                222
0062   3C03F5   223          cntr = 63;                      {check 64 taps}
0063   20580F   224          mr = 0;                         {clear the result accumulator}
0064   402006   225          my0 = 512;                      {1/64 in 1.15 format}
0065   380000u  226          i4 = ^long_avg.                 {point to the long term averager}
                227
0066   700022   228          mx0 = dm(i4,m6);                {get the first averager tap}
```

```
0067   14000Eu   229          do offset until ce;                {do it}
0068   710022    230  offset: mr = mr+mx0*my0(ss),mx0=dm(i4,m6); {add 1/64th of it to accumulator}
0069   20400F    231          mr = mr+mx0*my0(rnd);              {do the last one}
006A   050000    232          if mv sat mr;                      {saturate if necessary}
006B   0D005C    233          ay1 = mr1;                         {then save the result}
                 234
                 235
                 236  {        ...then check the AC energy content     }
                 237
006C   3C0405    238          cntr = 64;                         {check 64 MSW averager taps}
006D   209B0F    239          mr = 0;                            {zero the error calculation}
006E   45A827    240          my1 = 23170;                       {sqrt(0.5) in 1.15 format}
006F   380000u   241          i4 = ^long_avg;                    {point to the long term avgr}
                 242
0070   14000Eu   243          do fltchk until ce;                {...}
0071   7000A2    244          ar = dm(i4,m6);                    {get a long term avgr tap}
0072   22EA0F    245          ar = ar - ay1;                     {remove the DC offset}
0073   0F32FF    246          sr = ashift ar by -1 (lo);         {divide by 2}
0074   0D006E    247          my0 = sr0;                         {setup to square it}
0075   21060F    248  fltchk: mr = mr + sr0 * my0 (ss);          {square it and accumulate}
0076   050000    249          if mv sat mr;                      {saturate if necessary}
                 250
0077   4086B4    251          ay0 = imp_lo_lim;                  {get the impulse power lower limit}
0078   22E40F    252          ar = mr1 - ay0;                    {is result above lower limit ?}
0079   180004u   253          if lt jump fltbad;                 {if not, filter is no good}
                 254
007A   421AC4    255          ay0 = imp_hi_lim;                  {get the impulse power upper limit}
007B   22E4CF    256          ar = mr1 - ay0;                    {is result below upper limit ?}
007C   180002u   257          if gt jump fltbad;                 {if not, filter is no good}
                 258
007D   0D00A5    259          ar = ay1;                          {get the dc offset of the input}
007E   23E20F    260          ar = abs ar;                       {take the absolute value}
007F   404444    261          ay0 = offset_lim;                  {check it against the limit}
0080   22E20F    262          ar = ar - ay0;                     {...}
0081   180002u   263          if gt jump fltbad;                 {if over, filter is no good}
0082   18000Fu   264          jump fltok;                        {else, filter must be good}
                 265
                 266
                 267  {        ...if filter test failed, stay here (no det algorithm) }
                 268
0083   1C000Fu   269  fltbad: call led_green;                     {make the LED green}
0084   400644    270          ay0 = 100;                         {...for 1 Sec }
0085   1C000Fu   271          call delay;                        {...}
                 272
0086   1C000Fu   273          call led_off;                      {turn the LED off}
0087   400324    274          ay0 = 50;                          {...for 0.5 Sec }
0088   1C000Fu   275          call delay;                        {...}
                 276
0089   1C000Fu   277          call led_red;                      {make the LED flash red once}
008A   400324    278          ay0 = 50;                          {...for 0.5 Sec }
008B   1C000Fu   279          call delay;                        {...}
                 280
008C   1C000Fu   281          call led_off;                      {turn the LED off}
008D   400324    282          ay0 = 50;                          {...for 0.5 Sec }
008E   1C000Fu   283          call delay;                        {...}
                 284
008F   18000Fu   285          jump fltbad;                       {repeat}
                 286
                 287  fltok:
                 288
                 289
                 290  { --- Turn on the Tx signal --- }
```

```
                291
0090    40003A  292          ar = b#11;                    {Set tx level to 100% }
0091    90000Au 293          dm(txlevl) = ar;              {...}
0092    90000Au 294          dm(txlvl0) = ar;              {...}
0093    90000Au 295          dm(txlvl1) = ar;              {...}
                296
                297
                298   { --- Kill the test pulse, and look at the TX voltage --- }
                299
0094    40009A  300          ar = b#00001001;              {select TXV input, no gain }
0095    90000Au 301          dm(par_port) = ar;            {write it out to the parallel port}
0096    400C84  302          ay0 = 200;                    {wait 2 seconds}
0097    1C000Fu 303          call delay;                   {...}
                304
                305   { --- make sure we have something in the long term averager --- }
                306
0098    380C00u 307          i4 = ^long_avg;               {point to the start of the lt avgr}
0099    209B0F  308          mr = 0;                       {zero the result}
009A    3C0405  309          cntr = 64;                    {check 64 samples}
009B    14000Eu 310          do txvchk until ce;           {do the check}
009C    700022  311          mx0 = dm(i4,m6);              {got a txv sample}
009D    0D0062  312          my0 = mx0;                    {...}
009E    21000F  313   txvchk: mr = mr + mx0 * my0 (ss);    {square and sum it}
009F    050C00  314          if mv sat mr;                 {saturate if necessary}
00A0    40FA04  315          ay0 = 4000;                   {are we getting any tx output}
00A1    22E40F  316          ar = mr1 - ay0;               {...(trips at approx 4.75Vrms) }
00A2    180002u 317          if gt jump txvok;             {if so, power amp is ok}
                318
                319   { --- if no tx output indicate power amp error code --- }
                320
00A3    1C000Fu 321   ampbad: call led_green;              {make the LED green}
00A4    400644  322          ay0 = 100;                    {...for 1 Sec }
00A5    1C000Fu 323          call delay;                   {...}
                324
00A6    1C000Fu 325          call led_off;                 {turn the LED off}
00A7    400324  326          ay0 = 50;                     {...for 0.5 Sec }
00A8    1C000Fu 327          call delay;                   {...}
                328
00A9    1C000Fu 329          call led_red;                 {make the LED flash red once}
00AA    400324  330          ay0 = 50;                     {...for 0.5 Sec }
00AB    1C000Fu 331          call delay;                   {...}
                332
00AC    1C000Fu 333          call led_off;                 {turn the LED off}
00AD    400324  334          ay0 = 50;                     {...for 0.5 Sec }
00AE    1C000Fu 335          call delay;                   {...}
                336
00AF    1C000Fu 337          call led_red;                 {make the LED flash red a second time}
00B0    400324  338          ay0 = 50;                     {...for 0.5 Sec }
00B1    1C000Fu 339          call delay;                   {...}
                340
00B2    1C000Fu 341          call led_off;                 {turn the LED off}
00B3    400324  342          ay0 = 50;                     {...for 0.5 Sec }
00B4    1C000Fu 343          call delay;                   {...}
00B5    18000Fu 344          jump ampbad;                  {repeat}
                345
                346
                347
                348   { --- set the analog input back to what it should be ---}
                349
00B6    40011A  350   txvok:  ar = frtend;                  {operational gain and input select }
00B7    90000Au 351          dm(par_port) = ar;            {...}
00B8    90000Au 352          dm(out_img) = ar;             {...}
```

```
                353
                354
00B9   380000u  355          i4 = *long_avg;                {clear the long term averager}
00BA   3C0805   356          cntr = 128;
00BB   14000Eu  357          do clrlta until ce;
00BC   B00001   358   clrlta: dm(i4,m5) = 0x0000;
                359
                360
                361   { --- then boot up to the next page.... --- }
                362
00BD   40E5FA   363          ar = b#0000111001011111;       {boot up to the 2nd page}
00BE   93FFFA   364          dm(0x3fff) = ar;               {...}
                365
                366
                367
                368
                369
                370   {-----------------------------------------------------------------}
                371   { ---    Dual Color LED Control Routines                        --- }
                372   {-----------------------------------------------------------------}
                373
                374
                375   led_off:
00BF   40000A   376          ar = 0;                        {else, turn the LED off }
00C0   90000Au  377          dm(led_a) = ar;                {...}
00C1   90000Au  378          dm(led_b) = ar;                {...}
00C2   0A000F   379          rts;                           {exit }
                380
                381   led_red:
00C3   40000A   382          ar = 0;                        {make the LED red}
00C4   90000Au  383          dm(led_a) = ar;                {...}
00C5   40001A   384          ar = 1;                        {...}
00C6   90000Au  385          dm(led_b) = ar;                {...}
00C7   0A000F   386          rts;                           {done, exit}
                387
                388   led_green:
00C8   40001A   389          ar = 1;                        {make the LED green}
00C9   90000Au  390          dm(led_a) = ar;                {...}
00CA   40000A   391          ar = 0;                        {...}
00CB   90000Au  392          dm(led_b) = ar;                {...}
00CC   0A000F   393          rts;                           {done, exit}
                394
                395   led_yellow:
00CD   80000Au  396          ar = dm(aux_tmr);              {counter toggles every 10mS}
00CE   90000Au  397          dm(led_a) = ar;                {...}
00CF   23620F   398          ar = not ar;                   {...}
00D0   90000Au  399          dm(led_b) = ar;                {...}
00D1   0A000F   400          rts;                           {done, exit}
                401
                402
                403
                404   {-----------------------------------------------------------------}
                405   { ---   Analog to Digital Converter interrupt service routine   --- }
                406   { ---   64 X F0                                                 --- }
                407   {-----------------------------------------------------------------}
                408
                409   atod_int:
00D2   0C0C30   410          ena sec_reg;                   {select the secondary register set}
00D3   0D038A   411          si = rx1;                      {get the 12 bit signed analog input}
00D4   0F1004   412          sr = lshift si by 4 (lo);      {turn it into a 16 bit signed value}
00D5   90000Eu  413          dm(sample) = sr0;              {save it for the D>A routine}
                414
                415
```

```
                416   {      --- Run the long term averager, double precision ---      }
                417
00D6   0C0800   418          dis ar_sat;                    {disable saturation for DP math}
                419
00D7   600055   420          ay1 = dm(i1,m1);               {get the present averager tap MSW }
00D8   500044   421          ay0 = dm(i1,m0);               {...and the LSW}
00D9   800001u  422          ax1 = dm(sample);              {get the input sample MSW}
00DA   400000   423          ax0 = 0x0000;                  {...and the LSW}
                424
00DB   22E00F   425          ar = ax0 - ay0;                {LSW of input - present tap}
00DC   0D002A   426          mx0 = ar;                      {...save it }
00DD   22C50F   427          ar = ax1 - ay1 + c - 1;        {MSW of input - present tap}
00DE   0D003A   428          mx1 = ar;                      {...save it }
                429
00DF   4014C6   430          my0 = ltavg_tc;                {get the time constant}
00E0   20C00F   431          mr = mx0 * my0 (us);           {scale LSW of (inp-tap) by time const}
00E1   0D00BC   432          mr0 = mr1;                     {slice it into LSW of result reg}
00E2   0D00CD   433          mr1 = mr2;                     {...}
00E3   21C10F   434          mr = mr + mx1 * my0 (ss);      {scale MSW and add it to the result}
                435
00E4   22630F   436          ar = mr0 + ay0;                {then do the final summation}
00E5   6800A7   437          dm(i1,m3) = ar;                {...}
00E6   224C0F   438          ar = mr1 + ay1 + c;            {...}
00E7   6800A6   439          dm(i1,m2) = ar;                {...}
00E8   90000Au  440          dm(avg_long) = ar;             {save MSW of result for display}
                441
00E9   0C0C00   442          ena ar_sat;                    {re-enable ALU saturation}
                443
                444   {      --- Exit From The Interrupt Routine ---      }
                445
                446   atod_end:
00EA   800004u  447          ay0 = dm(sample_cnt);          {get the sample counter}
00EB   400405   448          ay1 = 64;                      {and the max value + 1}
00EC   22200F   449          ar = ay0 + 1;                  {update it}
00ED   26EA0F   450          af = ar - ay1;                 {did it reach 64 ?}
00EE   221805   451          if ge ar = pass 0;             {if so, set it back to 0}
00EF   90000Au  452          dm(sample_cnt) = ar;           {...}
                453
00F0   800004u  454          ay0 = dm(avg_long);            {get the output value}
00F1   22A00F   455          ar = -ay0;                     {invert it for the DAC}
00F2   0F32F8   456          sr = ashift ar by -8 (lo);     {set up for 8 bit D to A output }
00F3   400804   457          ay0 = 0x80;                    {convert from signed to unsigned}
00F4   22660F   458          ar = sr0 + ay0;                {...}
00F5   0D0CBA   459          tx1 = ar;                      {send it out the serial port}
                460
00F6   0C0020   461          dis sec_reg;                   {back to the primary register set}
00F7   0A001F   462          rti;                           {done, exit}
                463
                464
                465
                466
                467   {      Backround task AY0 = 10mS Delay Subroutine      }
                468
00F8   4D001A   469   delay: ar = 1;                        {set the timer flag}
00F9   90000Au  470          dm(tmr_flg) = ar;              {...}
00FA   800005u  471   waitlp: ay1 = dm(tmr_flg);            {then wait for it to clear}
00FB   22080F   472          ar = pass ay1;                 {...}
00FC   180001u  473          if ne jump waitlp;             {...}
00FD   80000Au  474          ar = dm(pet_dog);              {pet the dog}
00FE   23000F   475          ar = ay0 - 1;                  {done ?}
00FF   0D004A   476          ay0 = ar;                      {...}
0100   18C001u  477          if ne jump delay;              {if not, keep looping}
0101   0A000F   478          rts;                           {else, done, exit}
```

```
479
480
481   .endmod;                                    {end of this module}
482
```

```
1    {
2    ADSP-2105 based MM-3000 System, 218Hz or 875Hz
3    Serial Port 1 is used for Analog I/O, external clock & strobe
4    Serial Port 0 not available on ADSP-2105
5    10.000MHz clock
6    Double Precision Averagers
7    }
8
9    .module/boot=1/abs=0x0000 mm3000_run;
10   .pagelength 55;
11
12   {        *** Some Useful Definitions ***          }
13
14   #ifdef std
15
16   .const version = 0x00;          {software version number }
17   .const ltavg_tc = 200;          {long term averager time constant}
18   .const stavg_tc = 800;          {short term averager time constant}
19   .const nc_chg_tc = 4096;        {noise chnl peak det charge time const}
20   .const nc_dis_tc = 1024;        {noise chnl peak det discharge time const}
21   .const inh_chg_tc = 4096;       {inhibit chnl peak det charge time const}
22   .const inh_dis_tc = 1024;       {inhibit chnl peak det discharge time const}
23   .const sigch_tc = 2624;         {signal chn low pass filter time const}
24   .const d_avg_gain = 3;          {post differential averager gain (N x 6dB)}
25
26   #endif
27
28   #ifdef mini11
29
30   .const version = 0x00;          {software version number }
31   .const ltavg_tc = 200;          {long term averager time constant}
32   .const stavg_tc = 800;          {short term averager time constant}
33   .const nc_chg_tc = 4096;        {noise chnl peak det charge time const}
34   .const nc_dis_tc = 1024;        {noise chnl peak det discharge time const}
35   .const inh_chg_tc = 32767;      {inhibit chnl peak det charge time const}
36   .const inh_dis_tc = 1024;       {inhibit chnl peak det discharge time const}
37   .const sigch_tc = 2624;         {signal chn low pass filter time const}
38   .const d_avg_gain = 3;          {post differential averager gain (N x 6dB)}
39
40   #endif
41
42
43   {        *** Data Memory Variables ***          }
44
45   .var/dm/ram/circ nb_bufr[128];          {noise blanker sample buffer}
46   .var/dm/ram/circ shrt_avg[128];         {short term avgr MSW,LSW}
47   .var/dm/ram/circ long_avg[128];         {long term avgr MSW,LSW}
48   .var/dm/ram/circ tx_v[32];              {last FD cycle of tx voltage samples}
49   .var/dm/ram/circ aux_samples[16];       {all 16 auxilliary input samples}
50
51
52   {        *** Declare as Global Everything used in the startup module ***          }
53
54   .global nb_bufr;
55   .global shrt_avg;
```

```
56   .global long_avg;
57   .global sample_cnt;
58   .global txlevl;
59   .global tmr_flg;
60   .global sample;
61   .global almsm1;
62   .global out_img;
63   .global txctl_tmr;
64   .global aux_tmr;
65   .global bfw;
66   .global avg_shrt;
67   .global avg_long;
68
69   { ...then next 8 variables are sent out to the D>A converter in the
70     order listed on sequential frames in operating mode}
71
72   .var/dm/ram nb_out;                    {the noise blanker output}
73   .var/dm/ram avg_shrt;                  {short term avg, updated every sample}
74   .var/dm/ram d_avg;                     {differential averager output}
75   .var/dm/ram inh_disp;                  {alt inhibit level/inhibit threshold}
76   .var/dm/ram sigavg;                    {per cycle signal average}
77   .var/dm/ram nseavg;                    {per cycle noise voltage}
78   .var/dm/ram signal_level;              {TP9, gain adjusted "signal_det"}
79   .var/dm/ram noise_level;               {TP10, gain adj'd & offset "noise_det"}
80
81   .var/dm/ram sample;                    {a to d sample}
82   .var/dm/ram avg_long;                  {long term averager}
83   .var/dm/ram ampdis;                    {power amplifier dissapation }
84   .var/dm/ram signal_det;                {signal detector}
85   .var/dm/ram noise_det;                 {noise peak detector}
86   .var/dm/ram inhbt_flt;                 {inhibit channel filter}
87   .var/dm/ram inhavg;                    {inhibit channel energy accumulator}
88   .var/dm/ram sample_cnt;                {sample counter}
89   .var/dm/ram frame_cnt;                 {frame (f0) counter}
90   .var/dm/ram out_img;                   {output port ram image}
91   .var/dm/ram bfw;                       {the bit flag word}
92   .var/dm/ram alm_dis;                   {0x0ffff = disable alarms}
93   .var/dm/ram frc_low;                   {0x0ffff = force low line mode}
94   .var/dm/ram txlevl;                    {bits 1,0 = txlvl1,txlvl0}
95   .var/dm/ram noise_gain;                {P3, noise gain}
96   .var/dm/ram signal_offset;             {P4, signal offset}
97   .var/dm/ram inhbt_thrsh;               {P5, inhibit threshold}
98   .var/dm/ram nb_k;                      {P6, noise blanker threshold}
99   .var/dm/ram bzrtmr_ld;                 {P7, buzzer timer reload}
100  .var/dm/ram lmptmr_ld;                 {P8, lamp timer reload}
101  .var/dm/ram bzrtmr;                    {alarm buzzer one-shot}
102  .var/dm/ram lmptmr;                    {alarm lamp one-shot}
103  .var/dm/ram old_alm;                   {non-retrigger flag}
104  .var/dm/ram almsm1;                    {lamp/buzzer fail sample 1}
105  .var/dm/ram almsm2;                    {lamp/buzzer fail sample 2}
106  .var/dm/ram almchk1_tmr;               {alarm sample 1 timer}
107  .var/dm/ram almchk2_tmr;               {alarm sample 2 timer}
108  .var/dm/ram synchk_tmr;                {external sync input check timer}
109  .var/dm/ram txctl_tmr;                 {tx control timer delay }
110  .var/dm/ram tmr_flg;                   {cleared every 10mS}
111  .var/dm/ram aux_flag;                  {auxilliary parameter read flag}
112  .var/dm/ram aux_tmr;                   {auxilliary parameter read timer}
113  .var/dm/ram txlvl_save;                {old tx level save when in tx cntrl}
114  .var/dm/ram old_sig;                   {up or down ref for sig ch}
115  .var/dm/ram almtrg;                    {alarm non-retrigger flag}
116  .var/dm/ram txburp;                    {flag to indicate tx temp killed}
117  .var/dm/ram old_sync;                  {last pass sync lead status}
118
```

```
                119
                120   {       *** Program Memory Variables ***        }
                121
                122   .var/pm/ram/circ tx_i[32];              {last F0 cycle of tx current samples}
                123
                124
                125   {       *** I/O Port declaration  ***       }
                126
                127   .port mailbox;          {inter-processor mailbox (d0-d7)}
                128   .port par_port:         {general purpose parallel I/O port}
                129
                130   .port hndshk_out;       {d0 = handshake lead to microcntrlr}
                131   .port tx1v10;           {"  " lsb of tx sine level}
                132   .port tx1v11;           {"  " msb of tx sine level}
                133   .port reset_micro:      {"  " reset to microcntrl}
                134   .port led_a;            {"  " red LED cathode, green LED anode}
                135   .port led_b;            {"  " red LED anode, green LED cathode}
                136   .port lamp:             {"  " alarm lamp enable }
                137   .port buzzer;           {" , " alarm buzzer enable }
                138   .port pet_dog;          {read this to reset the watchdog timer}
                139
                140
                141   {       !!! !!! !!! code starts here !!! !!! !!!       }
                142
                143           { --- interrupt vectors --- }
                144
0000    18000Fu 145           jump cold;                      {hardware reset location}
0001    000000  146           nop;nop;nop;                    {skip 3 locations}
0002    000000
0003    000000
                147
0004    0A001F  148           rti;nop;nop;nop;                {external IRQ2 tied to f0, not used}
0005    000000
0006    000000
0007    000000
                145
0008    0A001F  150           rti;nop;nop;nop;                {SPORT 0 Tx not supported on 2105}
0009    000000
000A    000000
000B    000000
                151
000C    0A001F  152           rti;nop;nop;nop;                {SPORT 0 Rx not supported on 2105}
000D    000000
000E    000000
000F    000000
                153
0010    0A001F  154           rti;nop;nop;nop;                {SPORT 1 Tx, dual 8bit D>A, not used}
0011    000000
0012    000000
0013    000000
                155
0014    18000Fu 156           jump atod_int;                  {SPORT 1 Rx, 12 bit A to D}
0015    000000  157           nop;nop;nop;                    {skip 3 locations}
0016    000000
0017    000000
                158
                159
                160   {       timer interrupt ...     }
                161
0018    0C0030  162           ena sec_reg;                    {select the secondary register set}
0019    40000A  163           ar = 0x0000;                    {clear the timer flag }
001A    90000Au 164           dm(tmr_flg) = ar;               {...}
001B    0C0020  165           dis sec_reg;                    {back to the main register set }
```

```
001C   0A001F   166          rti;                          {done, exit }
                167
                168
                169   { --- Cold boot code starts here --- }
                170
001D   3C0003   171   cold:   imask = b#000000;            {kill all of the interrupts}
                172
                173
                174   { --- setup all of the DAG's (Data Address Generators) ---}
                175
001E   340000u  176          i0 = ^shrt_avg;               {point to short term avgrs}
001F   34C001u  177          i1 = ^long_avg;               {point to long term avgrs}
                178   {      i2 = 0x0000;                  general purpose interrupt rtn pntr}
                179   {      i3 = 0x0000;                  "                                 "}
                180
                181   {      i4 = 0x0000;                  gen purp backround task index reg}
                182   {      i5 = 0x0000;                  "                                 "}
                183   {      i6 = 0x0000;                  gen purp interrupt routine pointer}
0020   330003u  184          i7 = ^nb_bufr;                {two frame noise blanker buffer }
                185
                186   {      l0 = 128;                     the number of short term avg taps}
                187   {      l1 = 128;                     "          " long  "            "}
                188   {      l2 = ;                        general purpose pointers}
                189   {      l3 = ;                        "                          "}
                190
                191   {      l4 = 0;                       general purpose pointers}
                192   {      l5 = 0;                       ... }
                193   {      l6 = 0;                       ... }
                194   {      l7 = 128;                     the size of the noise blanker }
                195
                196   {      Wait here for the falling edge of F0       }
                197
0021   3C0203   198          imask = b#100000;             {enable IRQ2 interrupts}
0022   028000   199          idle;                         {wait for an F0 edge}
0023   028000   200   frm0wt: idle;                        {...and the next one}
0024   800000u  201          ax0 = dm(par_port);           {wait for frame 0}
0025   400074   202          ay0 = 7;                      {...}
0026   23800F   203          ar = ax0 and ay0;             {...}
0027   180001u  204          if ne jump frm0wt;            {...}
0028   3C002C   205          ifc = b#000000000010;         {force clear any pending SPORT1 Rx int}
0029   000000   206          nop;
002A   3C002C   207          ifc = b#000000000010;
                208
002B   40000A   209          ar = 0;                       {align the sample counter}
002C   90000Au  210          dm(sample_cnt) = ar;          {... }
                211
                212
                213   { --- Setup, then enable Interrupts --- }
                214
002D   3C0033   215          imask = b#000011;             {enable timer and SPORT1 Rx interrupts}
002E   0CC00C   216          ena timer;                    {turn on the timer}
                217
                218
                219   {-----------------------------------------------------}
                220   { ***     background task main calling loop        *** }
                221   {-----------------------------------------------------}
                222
                223   main_loop:
002F   800000u  224          ax0 = dm(tmr_flg);            {wait here for the timer flag to clear}
0030   22780F   225          ar = pass ax0;                {... }
0031   180001u  226          if ne jump main_loop;         {... }
                227
0032   1C000Fu  228          call pot_set;                 {convert acquired values to pot set}
```

```
0033   1C000Fu  229        call cmnd_proc;          {go process any commands from uC}
0034   1C000Fu  230        call tx_ctl;             {tx level control processor}
0035   1C000Fu  231        call ac_line;            {check the AC line voltage}
0036   1C000Fu  232        call alm_prc;            {handle the alarm output}
0037   1C000Fu  233        call sync_mon;           {test the sync input}
0038   1C000Fu  234        call inh_prc;            {go handle the inhibit}
0039   1C000Fu  235        call aux_supv;           {go read the aux inputs periodically}
003A   1C000Fu  236        call led_ctl;            {handle the LED }
                237
003B   3C000Au  238        ar = dm(pet_dog);        {pet the dog}
003C   45555A   239        ar = 0x5555;             {set the 10m5 flag}
003D   90000Au  240        dm(tmr_flg) = ar;        {...}
003E   18000Fu  241        jump main_loop;          {then keep doing the background loop}
                242
                243  {------- end of backround task main calling loop ------}
                244
                245
                246
                247
                248  {-----------------------------------------------------}
                249  {      Background task POT set subroutine             }
                250  {-----------------------------------------------------}
                251
                252  pot_set:
003F   800008u  253        si = dm(aux_samples + 12);   {get the pot 3 read value (1.15)}
0040   0F30FF   254        sr = ashift si by -1 (lo);   {divide by 2}
0041   440004   255        ay0 = 0x4000;                {add offset so always positive}
0042   22660F   256        ar = sr0 + ay0;              {...}
0043   90000Au  257        dm(noise_gain) = ar;         {save it}
                258
0044   800008u  259        si = dm(aux_samples + 13);   {get the pot 4 read value (1.15)}
0045   0F30FE   260        sr = ashift si by -2 (lo);   {divide by 4}
0046   90000Eu  261        dm(signal_offset) = sr0;     {save it}
                262
0047   800002u  263        mx0 = dm(aux_samples + 14);  {get the pot 5 read value (1.15)}
0048   430006   264        my0 = 12288;                 {multiply by .375}
0049   20200F   265        mr = mx0 * my0 (rnd);        {...}
004A   430004   266        ay0 = 12288;                 {then add .375 so always positive}
004B   22640F   267        ar = mr1 + ay0;              {...}
004C   90000Au  268        dm(inhbt_thrsh) = ar;        {save it}
                269
004D   800008u  270        si = dm(aux_samples + 11);   {get the pot 6 read value (1.15)}
004E   0F30FF   271        sr = ashift si by -1 (lo);   {divide by 2}
004F   22660F   272        ar = sr0 + ay0;              {... }
0050   90000Au  273        dm(nb_k) = ar;               {save it}
                274
0051   800008u  275        si = dm(aux_samples + 5);    {get the pot 7 read value (1.15)}
0052   0F30FE   276        sr = ashift si by -8 (lo);   {divide by 256}
0053   400804   277        ay0 = 128;                   {add offset so always positive}
0054   22660F   278        ar = sr0 + ay0;              {...}
0055   90000Au  279        dm(bzrtmr_ld) = ar;          {save it}
                280
0056   800008u  281        si = dm(aux_samples + 6);    {get the pot 8 read value (1.15)}
0057   0F30FA   282        sr = ashift si by -6 (lo);   {divide by 64}
0058   402004   283        ay0 = 512;                   {add offset so always positive}
0059   22660F   284        ar = sr0 + ay0;              {...}
005A   90000Au  285        dm(lmptmr_ld) = ar;          {save it}
                286
005B   0A000F   287        rts;                         {done, exit}
                288
                289  {      ...end of the POT value set subroutine  }
                290
```

```
                291
                292
                293   {-----------------------------------------------}
                294   {        COMMAND PROCESSOR SUBROUTINE           }
                295   {-----------------------------------------------}
                296   cmnd_proc:
005C    800000u 297           ax0 = dm(par_port);          {get the handshake lead from the micro}
005D    400104  298           ay0 = b#00010000;            {handshake lead mask}
005E    23300F  299           ar = ax0 and ay0;            {test the handshake input bit}
005F    0A0001  300           if ne rts;                   {if low, go process command}
                301
0060    800000u 302           ax0 = dm(mailbox);           {read the mailbox}
0061    400FF4  303           ay0 = 0x00ff;                {zero the high bits}
0062    27800F  304           af = ax0 and ay0;            {...}
                305
                306
                307   {        ...decode the command  }
                308
0063    400080  309           ax0 = 0x80;                  {zero data byte command ?}
0064    23300F  310           ar = ax0 and af;             {...}
0065    180001u 311           if ne jump zero_byte;        {if so, go do it}
                312
0066    18000Fu 313           jump bad_op;                 {2,3,4,5,6 byte commands not yet def.}
                314
                315
                316
                317
                318   {        Zero Data Byte Command Processor }
                319
                320   zero_byte:
0067    400080  321           ax0 = 0x80;                  {is it opcode 80 ?}
0068    27300F  322           af = af - ax0;               {...}
0069    180000u 323           if eq jump nul_cmd;          {...if so, null command}
006A    27100F  324           af = af - 1;                 {is it opcode 81 ?}
006B    180000u 325           if eq jump bfw_req;          {...if so, bit flag word request}
006C    27100F  326           af = af - 1;                 {is it opcode 82 ?}
006D    180000u 327           if eq jump posrail;          {...if so, get positive rail voltage}
006E    27100F  328           af = af - 1;                 {is it opcode 83 ?}
006F    180000u 329           if eq jump negrail;          {...if so, get negative rail voltage}
0070    27100F  330           af = af - 1;                 {is it opcode 84 ?}
0071    180000u 331           if eq jump get_txv;          {...if so, get peak Tx voltage}
0072    27100F  332           af = af - 1;                 {is it opcode 85 ?}
0073    180000u 333           if eq jump get_txi;          {...if so, get peak Tx current}
0074    27100F  334           af = af - 1;                 {is it opcode 86 ?}
0075    180000u 335           if eq jump nul_cmd;          {...get bias not implemented}
0076    400060  336           ax0 = 6;                     {is it opcode 87-8C ?}
0077    27300F  337           af = af - ax0;               {...}
0078    180003u 338           if le jump get_pots;         {...if so, get pots}
0079    27100F  339           af = af - 1;                 {is it opcode 8D ?}
007A    180000u 340           if eq jump get_phase;        {...if so, get antenna v/i phase}
007B    27100F  341           af = af - 1;                 {is it opcode 8E ?}
007C    180000u 342           if eq jump get_gain;         {...if so, get front-end gain setting}
007D    27100F  343           af = af - 1;                 {is it opcode 8F ?}
007E    180000u 344           if eq jump get_vers;         {...if so, get software version number}
007F    400110  345           ax0 = 17;                    {is it opcode A0 ?}
0080    27300F  346           af = af - ax0;               {...}
0081    180000u 347           if eq jump dis_alm;          {...if so, go disable alarms}
0082    27100F  348           af = af - 1;                 {is it opcode A1 ?}
0083    180000u 349           if eq jump ena_alm;          {...if so, go re-enable alarms}
0084    27100F  350           af = af - 1;                 {is it opcode A2 ?}
0085    180000u 351           if eq jump default;          {...if so, go set system to defaults}
0086    27100F  352           af = af - 1;                 {is it opcode A3 ?}
0087    180000u 353           if eq jump flowln;           {...if so, force low line mode}
```

```
008S   27100F   254          af = af - 1;                    {is it opcode A4 ?}
0089   180000u  355          if eq jump ulowln;              {...if so, un-force low line mode}
008A   27100F   356          af = af - 1;                    {is it opcode A5 ?}
008B   180000u  357          if eq jump dis_tx;              {...if so, turn off the tx sine}
008C   27100F   358          af = af - 1;                    {is it opcode A6 ?}
008D   180000u  359          if eq jump ena_tx;              {...if so, turn on the tx sine}
008E   18000Fu  360          jump bad_op;                    {must be a bad opcode}
                361
                362
                363  {       Null Command (80) processor     }
                364
                365  nul_cmd:
008F   40080A   366          ar = 0x80;                      {tell uC no data bytes follow}
0090   90000Au  367          dm(mailbox) = ar;               {...}
0091   1C000Fu  368          call hndshk;                    {...}
0092   0A000F   369          rts;                            {done, exit}
                370
                371
                372  {       Bit Flag Word request (81) processor    }
                373
                374  bfw_req:
0093   40040A   375          ar = 0x40;                      {tell uC one more byte follows}
0094   90000Au  376          dm(mailbox) = ar;               {...}
0095   1C000Fu  377          call hndshk;                    {...}
0096   80000Au  378          ar = dm(bfw);                   {get the stored bit flag word}
0097   90000Au  379          dm(mailbox) = ar;               {save it for the handshake}
0098   1C000Fu  380          call hndshk;                    {do the handshake}
0099   0A000F   381          rts;                            {done, return to main calling loop}
                382
                383
                384  {       Positive Supply Rail Voltage Request Processor (82)     }
                385
                386  posrail:
009A   40040A   387          ar = 0x40;                      {tell uC one more byte follows}
009B   90000Au  388          dm(mailbox) = ar;               {...}
009C   1C000Fu  389          call hndshk;                    {...}
009D   800008u  390          si = dm(aux_samples + 10);      {get the raw positive supply rail}
009E   0F10F9   391          sr = lshift si by -7 (lo);      {put unsigned value in 8 lsb's}
009F   90000Eu  392          dm(mailbox) = sr0;              {...then into the mailbox}
00A0   1C000Fu  393          call hndshk;                    {do the handshake}
00A1   0A000F   394          rts;                            {done, return to main loop}
                395
                396
                397  {       Negative Supply Rail Voltage Request Processor (83)     }
                398
                399  negrail:
00A2   40040A   400          ar = 0x40;                      {tell uC one more byte follows}
00A3   90000Au  401          dm(mailbox) = ar;               {...}
00A4   1C000Fu  402          call hndshk;                    {...}
00A5   800000u  403          ax0 = dm(aux_samples + 15);     {get the raw negative supply rail}
00A6   23E00F   404          ar = abs ax0;                   {make it a positive value}
00A7   0F12F9   405          sr = lshift ar by -7 (lo);      {put unsigned value in 8 lsb's}
00A8   90000Eu  406          dm(mailbox) = sr0;              {...then into the mailbox}
00A9   1C000Fu  407          call hndshk;                    {do the handshake}
00AA   0A000F   408          rts;                            {done, return to main loop}
                409
                410
                411  {       Get Peak Tx Voltage Request Processor (84)     }
                412
                413  get_txv:
00AB   40040A   414          ar = 0x40;                      {tell uC one more byte follows}
00AC   90000Au  415          dm(mailbox) = ar;               {...}
00AD   1C000Fu  416          call hndshk;                    {...}
```

```
00AE   1C000Fu   417          call maxtxv;                  {go get the peak transmit voltage}
00AF   0D0084    418          si = ay0;                     {get the 1.15 format max value}
00B0   0F10F9    419          sr = lshift si by -7 (lo);    {make it 8 bit magnitude}
00B1   90000Eu   420          dm(mailbox) = sr0;            {...then into the mailbox}
00B2   1C000Fu   421          call hndshk;                  {do the handshake}
00B3   0A000F    422          rts;                          {done, return to main loop}
                 423
                 424  maxtxv:
00B4   380001u   425          i5 = ^tx_v;                   {point to start of sample buffer}
00B5   3C0205    426          cntr = 32;                    {# of samples to check}
00B6   26180F    427          af = pass 0;                  {initial max is 0}
00B7   14000Eu   428          do fmaxv until ce;            {do it}
00B8   700005    429          ax0 = dm(i5,m5);              {get a sample from the buffer}
00B9   23E00F    430          ar = abs ax0;                 {...ignore the sign}
00BA   22F20F    431          ar = ar - af;                 {is this sample bigger than "af" ?}
00BB   27E002    432  fmaxv:  if gt af = abs ax0;           {if so, overwrite previous max}
00BC   2210CF    433          ar = pass af;                 {put in return reg}
00BD   0D004A    434          ay0 = ar;                     {...}
00BE   0A000F    435          rts;                          {done, exit}
                 436
                 437
                 438  {       Get Peak Tx Current Request Processor (85)      }
                 439
                 440  get_txi:
00BF   40040A    441          ar = 0x40;                    {tell uC one more byte follows}
00C0   90000Au   442          dm(mailbox) = ar;             {...}
00C1   1C000Fu   443          call hndshk;                  {...}
00C2   380001u   444          i5 = ^tx_i;                   {point to start of sample buffer}
00C3   3C0205    445          cntr = 32;                    {# of samples to check}
00C4   400004    446          ay0 = 0;                      {initial max is 0}
00C5   14000Eu   447          do fmaxi until ce;            {do it}
00C6   500005    448          ax0 = pm(i5,m5);              {get a sample from the buffer}
00C7   23E00F    449          ar = abs ax0;                 {...ignore the sign}
00C8   22E20F    450          ar = ar - ay0;                {is this sample bigger than "ax0" ?}
00C9   180003u   451          if le jump fmaxi;             {if not larger, keep present max}
00CA   23E00F    452          ar = abs ax0;                 {if so, save new max}
00CB   0D004A    453          ay0 = ar;                     {...}
00CC   000000    454  fmaxi:  nop;                          {end of the loop}
00CD   0D0084    455          si = ay0;                     {get the 1.15 format max value}
00CE   0F10F9    456          sr = lshift si by -7 (lo);    {make it 8 bit magnitude}
00CF   90000Eu   457          dm(mailbox) = sr0;            {...then into the mailbox}
00D0   1C000Fu   458          call hndshk;                  {do the handshake}
00D1   0A000F    459          rts;                          {done, return to main loop}
                 460
                 461
                 462
                 463  {       Get the Pot Settings (87-8C)    }
                 464
                 465  get_pots:
00D2   40040A    466          ar = 0x40;                    {tell uC one more byte follows}
00D3   90000Au   467          dm(mailbox) = ar;             {...}
00D4   1C000Fu   468          call hndshk;                  {...}
                 469
00D5   380001u   470          i5 = ^aux_samples + 6;        {is it the sixth pot ?}
00D6   26100F    471          af = pass af;                 {get the adjusted opcode}
00D7   180000u   472          if eq jump got_pot;           {if so, go get pot setting}
                 473
00D8   380001u   474          i5 = ^aux_samples + 5;        {is it the fifth pot ?}
00D9   26300F    475          af = af + 1;                  {...}
00DA   180000u   476          if eq jump got_pot;           {if so, go get pot setting}
                 477
00DB   380001u   478          i5 = ^aux_samples + 11;       {is it the fourth pot ?}
00DC   26300F    479          af = af + 1;                  {...}
```

```
00DD   180000u  480          if eq jump got_pot;          {if so, go get pot setting}
                481
00DE   380001u  482          i5 = ^aux_samples + 14;      {is it the third pot ?}
00DF   26300F   483          af = af + 1;                 {...}
00E0   180000u  484          if eq jump got_pot;          {if so, go get pot setting}
                485
00E1   380001u  486          i5 = ^aux_samples + 13;      {is it the second pot ?}
00E2   26300F   487          af = af + 1;                 {...}
00E3   180000u  488          if eq jump got_pot;          {if so, go get pot setting}
                489
00E4   380001u  490          i5 = ^aux_samples + 12;      {is it the first pot ?}
00E5   26300F   491          af = af + 1;                 {...}
00E6   180000u  492          if eq jump got_pot;          {if so, go get pot setting}
                493
                494     got_pot:
00E7   700084   495          si = dm(i5,m4);              {get the pot setting from table}
00E8   0F10F8   496          sr = lshift si by -8 (lo);   {make it an 8 bit value}
00E9   90000Eu  497          dm(mailbox) = sr0;           {...}
00EA   1C000Fu  498          call hndshk;                 {do the handshake}
00EB   0A000F   499          rts;                         {done, return}
                500
                501
                502
                503
                504     {        Get the Tx Antenna V/I phase (8D)        }
                505
                506     get_phase:
00EC   40040A   507          ar = 0x40;                   {tell uC one more byte follows}
00ED   90000Au  508          dm(mailbox) = ar;            {...}
00EE   1C000Fu  509          call hndshk;                 {...}
                510
00EF   1C000Fu  511          call phase_rtn;
                512
00F0   0F1203   513          sr = lshift ar by 3 (lo);    {make it a 8 bit unsigned value}
00F1   90000Eu  514          dm(mailbox) = sr0;           {...}
00F2   1C000Fu  515          call hndshk;                 {do the handshake}
00F3   0A000F   516          rts;                         {done, return}
                517
                518     phase_rtn:
00F4   380000u  519          i4 = ^tx_i;                  {start of the tx current array}
00F5   380001u  520          i5 = ^tx_v;                  {start of the tx voltage array}
00F6   26180F   521          af = pass 0;                 {counter of opposite sign samples}
00F7   3C0205   522          cntr = 32;                   {only need to check 32 samples}
                523
00F8   14000EU  524          do phs_lp until ce;          {this loop finds the phase}
00F9   500041   525          ay0 = pm(i4,m5);             {get a tx current sample}
00FA   7000A5   526          ar = dm(i5,m5);              {get a tx voltage sample}
00FB   23C20F   527          ar = ar xor ay0;             {exclsive or the two}
00FC   263004   528     phs_lp: if lt af = af + 1;        {if differing signs, count it}
00FD   22100F   529          ar = pass af;                {put the count in AR}
00FE   0A000F   530          rts;                         {done exit}
                531
                532
                533
                534
                535     {        Read Front End Gain Setting (8E)        }
                536
                537     get_gain:
00FF   40040A   538          ar = 0x40;                   {tell uC one more byte follows}
0100   90000Au  539          dm(mailbox) = ar;            {...}
0101   1C000Fu  540          call hndshk;                 {...}
                541
```

```
0102   800008u   542          si = dm(out_img);                {get the parallel port output image}
0103   0F10FC    543          sr = lshift si by -4 (lo);       {put the gain bits down low}
0104   90000Eu   544          dm(mailbox) = sr0;               {get the gain setting}
0105   1C000Fu   545          call hndshk;                     {do the handshake }
0106   0A000F    546          rts;                             {done, exit}
                 547
                 548
                 549
                 550   {       Get the Software Version Number (8F)    }
                 551
                 552   get_vers:
0107   40040A    553          ar = 0x40;                       {tell uC one more byte follows}
0108   90000Au   554          dm(mailbox) = ar;                {...}
0109   1C000Fu   555          call hndshk;                     {...}
                 556
010A   40000A    557          ar = version;                    {get the version number}
010B   90000Au   558          dm(mailbox) = ar;                {...in the mailbox}
010C   1C000Fu   559          call hndshk;                     {do the handshake }
010D   0A000F    560          rts;                             {done, exit}
                 561
                 562
                 563   {       Disable Alarms (A0)     }
                 564
                 565   dis_alm:
010E   40080A    566          ar = 0x80;                       {tell uC nothing follows}
010F   90000Au   567          dm(mailbox) = ar;                {...}
0110   1C000Fu   568          call hndshk;                     {...}
0111   4FFFFA    569          ar = 0x0ffff;                    {set the alarm disable flags}
0112   90000Au   570          dm(alm_dis) = ar;                {...}
0113   0A000F    571          rts;                             {done, exit}
                 572
                 573
                 574   {       Enable Alarms (A1)      }
                 575
                 576   ena_alm:
0114   40080A    577          ar = 0x80;                       {tell uC nothing follows}
0115   90000Au   578          dm(mailbox) = ar;                {...}
0116   1C000Fu   579          call hndshk;                     {...}
0117   40000A    580          ar = 0x0000;                     {set the alarm disable flags}
0118   90000Au   581          dm(alm_dis) = ar;                {...}
0119   0A000F    582          rts;                             {done, exit}
                 583
                 584
                 585
                 586   {       Restore System to Defaults (A2)         }
                 587
                 588   default:
011A   40080A    589          ar = 0x80;                       {tell uC nothing follows}
011B   90000Au   590          dm(mailbox) = ar;                {...}
011C   1C000Fu   591          call hndshk;                     {...}
011D   40000A    592          ar = 0x0000;                     {reset the alarm disable flags}
011E   90000Au   593          dm(alm_dis) = ar;                {...}
011F   90000Au   594          dm(frc_low) = ar;                {...and the output force bit}
0120   40003A    595          ar = b#11;                       {set tx output level to 100%}
0121   90000Au   596          dm(txlevl) = ar;                 {...}
0122   90000Au   597          dm(txlvl0) = ar;                 {...}
0123   90000Au   598          dm(txlvl1) = ar;                 {...}
0124   0A000F    599          rts;                             {done, exit}
                 600
                 601
                 602
                 603   {       Force Low Line Mode  (A3)       }
```

```
                604
                605   flowln:
0125   40080A   606          ar = 0x80;                    {tell uC nothing follows}
0126   90000Au   607          dm(mailbox) = ar;             {...}
0127   1C000Fu   608          call hndshk;                  {...}
0128   4FFFFA   609          ar = 0x0ffff;                 {set the force low line flag}
0129   90000Au   610          dm(frc_low) = ar;             {...}
012A   0A000F   611          rts;                          {done, exit}
                612
                613
                614   {       Un-Force Low Line Mode  (A4)   }
                615
                616   ulowln:
012B   40080A   617          ar = 0x80;                    {tell uC nothing follows}
012C   90000Au   618          dm(mailbox) = ar;             {...}
012D   1C000Fu   619          call hndshk;                  {...}
012E   40000A   620          ar = 0x0000;                  {reset the force low line flag}
012F   90000Au   621          dm(frc_low) = ar;             {...}
0130   0A000F   622          rts;                          {done, exit}
                623
                624
                625   {       Disable Tx Sine (A5)...   }
                626
                627   dis_tx:
0131   40080A   628          ar = 0x80;                    {tell uC nothing follows}
0132   90000Au   629          dm(mailbox) = ar;             {...}
0133   1C000Fu   630          call hndshk;                  {...}
0134   40000A   631          ar = b#00;                    {turn off the tx sine, set lvl code 00}
0135   90000Au   632          dm(txlevl) = ar;              {...}
0136   90000Au   633          dm(txlvl0) = ar;              {...}
0137   90000Au   634          dm(txlvl1) = ar;              {...}
0138   0A000F   635          rts;                          {done, exit}
                636
                637   {       Enable Tx Sine (A6)...    }
                638
                639   ena_tx:
0139   40080A   640          ar = 0x80;                    {tell uC nothing follows}
013A   90000Au   641          dm(mailbox) = ar;             {...}
013B   1C000Fu   642          call hndshk;                  {...}
013C   40002A   643          ar = b#10;                    {Set tx level to 75%, set lvl code 10}
013D   90000Au   644          dm(txlevl) = ar;              {...}
013E   90000Au   645          dm(txlvl0) = ar;              {...}
013F   40001A   646          ar = b#1;                     {...}
0140   90000Au   647          dm(txlvl1) = ar;              {...}
0141   0A000F   648          rts;                          {done, exit}
                649
                650
                651   {       invalid opcode ends up here, tell the microcontroller   }
                652
                653   bad_op:
0142   40083A   654          ar = 0x83;                    {get the invalid opcode response}
0143   90000Au   655          dm(mailbox) = ar;             {write it to the mailbox}
0144   1C000fu   656          call hndshk;                  {send the opcode, then we are finished}
0145   0A000F   657          rts;                          {done, return to main calling loop}
                658
                659
                660   {       ...end of the command processor subroutine      }
                661
                662
                663
                664   {-----------------------------------------------}
                665   {       Tx Level Control Subroutine             }
                666   {-----------------------------------------------}
```

```
                667
                668   tx_ctl:
                669
                670   {...calculate the power amp dissapation  }
                671
0146  800004u   672          ay0 = dm(txctl_tmr);          {is it time to check }
0147  23000F    673          ar = ay0 - 1;                 {...}
0148  220004    674          if lt ar = pass ay0;          {...}
0149  90000Au   675          dm(txctl_tmr) = ar;           {save the timer }
014A  0A0001    676          if ne rts;                    {if not timed out, keep waiting}
                677
014B  3C0205    678          cntr = 32;                    {32 samples is enough }
014C  380000u   679          i4 = ^tx_i;                   {point to the tx current array}
014D  380001u   680          i5 = ^tx_v;                   {...the tx voltage}
014E  20980F    681          mr = 0;                       {zero the result reg}
014F  800004u   682          ay0 = dm(aux_samples+10);     {get the positive supply rail}
0150  800005u   683          ay1 = dm(aux_samples+15);     {get the negative supply rail}
                684
0151  14000Eu   685          do powrlp until ce;           {do it !}
0152  500001    686          ax0 = pm(i4,m5);              {get the tx current }
0153  0D0060    687          my0 = ax0;                    {...save for the multiply }
0154  700015    688          ax1 = dm(i5,m5);              {and the tx voltage }
0155  26000F    689          af = pass ay0;                {assume that tx_i is positive}
0156  22780F    690          ar = pass ax0;                {check the sign }
0157  260804    691          if lt af = pass ay1;          {if negative, get negative supply }
0158  23310F    692          ar = af - ax1;                {calculate V_rail - V_out }
0159  20420F    693   powrlp: mr = mr + ar * my0 (rnd);    {..then multiply by the current }
                694
015A  0F25FB    695          sr = ashift mr2 by -5 (hi);   {divide result by 32}
015B  0F1CFB    696          sr = sr or lshift mr1 by -5 (lo);  {...}
015C  90000Eu   697          dm(ampdis) = sr0;             {save the result (2^15 = 422.5W)}
                698
015D  800004u   699          ay0 = dm(txlevl);             {get the current tx level setting}
015E  26000F    700          af = pass ay0;                {is it 0 ?}
015F  180000u   701          if eq jump tx_off;            {if so, check if we should restore}
0160  27100F    702          af = af - 1;                  {if not, is it 1 ?}
0161  180000u   703          if eq jump in_tx_ctl;         {if so, check if we should kill txctl}
0162  27100F    704          af = af - 1;                  {if not, is it 2 ?}
0163  180000u   705          if eq jump auto_up;           {if so, check if we should raise txv}
0164  27100F    706          af = af - 1;                  {if not, is it 3 ?}
0165  180000u   707          if eq jump auto_dwn;          {if so, check if we should drop txv}
0166  18000Fu   708          jump set_tx;                  {else error, set tx to valid lvl}
                709
                710
0167  800004u   711   tx_off: ay0 = dm(txburp);            {are we in burp mode ?}
0168  22000F    712          ar = pass ay0;                {...}
0169  0A0000    713          if eq rts;                    {if not, just leave the tx off}
016A  40001A    714          ar = b#1;                     {else, set tx level to 25x}
016B  90000Au   715          dm(txlevl) = ar;              {...}
016C  90000Au   716          dm(txlvl0) = ar;              {...}
016D  40000A    717          ar = 0;                       {...}
016E  90000Au   718          dm(txlvl1) = ar;              {...}
016F  90000Au   719          dm(txburp) = ar;              {end of the burp}
0170  40064A    720          ar = 100;                     {let power stabilize for 1 sec}
0171  90000Au   721          dm(txctl_tmr) = ar;           {...}
0172  0A000F    722          rts;
                723
                724
                725   in_tx_ctl:
0173  80000Au   726          ar = dm(ampdis);              {get the calculated dissapation }
0174  4183D4    727          ay0 = 6205;                   {is it still dangerously high ?}
0175  22E20F    728          ar = ar - ay0;                {...}
```

```
0176   180004u  729          if lt jump noprob;          {if not, check if ok to turn back up}
                730
0177   40000A   731   set_tx: ar = 0;                     {else, kill the tx signal completely}
0178   90000Au  732          dm(txlevl) = ar;            {...}
0179   90000Au  733          dm(txlvl0) = ar;            {...}
017A   90000Au  734          dm(txlvl1) = ar;            {...}
017B   401F4A   735          ar = 500;                   {...and keep it off for 5 seconds}
017C   90000Au  736          dm(txctl_tmr) = ar;         {...}
017D   90000Au  737          dm(txburp) = ar;            {...indicate the burp}
017E   0A000F   738          rts;                        {done, exit}
                739
017F   80000Au  740   noprob: ar = dm(ampdis);           {get the calculated dissapation }
0180   40A9A4   741          ay0 = 2714;                 { (35W/422.5W) * 2^15 }
0181   22E20F   742          ar = ar - ay0;              {compare to the threshold}
0182   180002u  743          if gt jump inhalm;          {if diss. still too high keep alm off}
                744
0183   1C000Fu  745          call phase_rtn;             {get the tx phase }
0184   400034   746          ay0 = 3;                    {is it less than 180*(3/32) = 17deg}
0185   22E20F   747          ar = ar - ay0;              {...}
0186   180002u  748          if gt jump inhalm;          {if not, don't turn the TX back up}
                749
0187   80000Au  750          ar = dm(txlvl_save);        {set the TX Voltage to old level}
0188   90000Au  751          dm(txlevl) = ar;            {...}
0189   90000Au  752          dm(txlvl0) = ar;            {...}
018A   0F12FF   753          sr = lshift ar by -1 (lo);  {...}
018B   90000Eu  754          dm(txlvl1) = sr0;           {...}
018C   400C8A   755          ar = 200;                   {don't do anything for 2 Sec }
018D   90000Au  756          dm(txctl_tmr) = ar;         {...}
018E   0A000F   757          rts;                        {done, exit }
                758
018F   40000A   759   inhalm: ar = 0;                    {kill the alarms}
0190   90000Au  760          dm(buzzer) = ar;            {...}
0191   90000Au  761          dm(lamp) = ar;              {...}
0192   800000u  762          ax0 = dm(bfw);              {...and the BFW status}
0193   485DF4   763          ay0 = 11110111;             {...}
0194   23800F   764          ar = ax0 and ay0;           {...}
0195   90000Au  765          dm(bfw) = ar;               {...}
0196   0A000F   766          rts;
                767
                768   auto_up:
0197   4183D4   769          ay0 = 6205;                 { (30W/422.5W) * 2^15 }
0198   22E60F   770          ar = sr0 - ay0;             {compare to the threshold}
0199   180002u  771          if gt jump do_txctl;        {if amp diss excessive do tx control }
                772
019A   800004u  773          ay0 = dm(frc_low);          {get the force low line flag}
019B   22000F   774          ar = pass ay0;              {are we forced in low line }
019C   0A0001   775          if ne rts;                  {if so, just exit }
019D   1C000Fu  776          call maxtxv;                {get the maximum txv in AY0}
019E   800000u  777          ax0 = dm(aux_samples + 10); {get the raw positive supply rail}
019F   22E00F   778          ar = ax0 - ay0;             {subtract the two}
01A0   424005   779          ay1 = 9216;                 {is rail at least 12V above peak txv ?}
01A1   22EA0F   780          ar = ar - ay1;              {...}
01A2   0A0004   781          if lt rts;                  {if not, do nothing}
01A3   40003A   782          ar = 3;                     {else turn tx level back up}
01A4   90000Au  783          dm(txlevl) = ar;            {...}
01A5   90000Au  784          dm(txlvl0) = ar;            {...}
01A6   90000Au  785          dm(txlvl1) = ar;            {...}
01A7   400C8A   786          ar = 200;                   {don't do anything for 2.00 Sec }
01A8   90000Au  787          dm(txctl_tmr) = ar;         {...}
01A9   0A000F   788          rts;                        {done, exit}
                789
                790   auto_dwn:
```

```
01AA   4183D4   791          ay0 = 6205;                    { (80W/422.5W) * 2^15 }
01AB   22E60F   792          ar = sr0 - ay0;                {compare to the threshold}
01AC   180002u  793          if gt jump do_txctl;           {if amp diss excessive do tx control }
                794
01AD   800004u  795          ay0 = dm(frc_low);             {get the force low line flag}
01AE   22000F   796          ar = pass ay0;                 {should we force the low line mode}
01AF   180000u  797          if eq jump no_frc;             {if not, go do auto low line comp.}
01B0   40002A   798          ar = b#10;                     {if so, force 75% output}
01B1   90000Au  799          dm(txlevl) = ar;               {...}
01B2   90000Au  800          dm(txlvl0) = ar;               {...}
01B3   0F12FF   801          sr = lshift ar by -1 (lo);     {...}
01B4   90000Eu  802          dm(txlvl1) = sr0;              {...}
01B5   4007DA   803          ar = 125;                      {don't do anything for 1.25 Sec }
01B6   90000Au  804          dm(txctl_tmr) = ar;            {...}
01B7   0A000F   805          rts;                           {done, exit }
                806
01B8   1C000Fu  807   no_frc: call maxtxv;                  {get the maximum txv in AY0}
01B9   800000u  808          ax0 = dm(aux_samples + 10);    {get the raw positive supply rail}
01BA   22E00F   809          ar = ax0 - ay0;                {subtract the two}
01BB   408005   810          ay1 = 0x0800;                  {is rail less than 2V above peak txv ?}
01BC   22EA0F   811          ar = ar - ay1;                 {...}
01BD   0A0002   812          if gt rts;                     {if not, do nothing}
01BE   40002A   813          ar = 2;                        {else turn tx level down}
01BF   90000Au  814          dm(txlevl) = ar;               {...}
01C0   90000Au  815          dm(txlvl0) = ar;               {...}
01C1   0F12FF   816          sr = lshift ar by -1 (lo);     {...}
01C2   90000Eu  817          dm(txlvl1) = sr0;              {...}
01C3   4007DA   818          ar = 125;                      {don't do anything for 1.25 Sec }
01C4   90000Au  819          dm(txctl_tmr) = ar;            {...}
01C5   0A000F   820          rts;                           {done, exit}
                821
                822
                823   do_txctl:
01C6   80000Au  824          ar = dm(txlevl);               {get the current tx level}
01C7   90000Au  825          dm(txlvl_save) = ar;           {save it}
01C8   40001A   826          ar = b#01;                     {then set TX output Voltage to 25% }
01C9   90000Au  827          dm(txlevl) = ar;               {...}
01CA   90000Au  828          dm(txlvl0) = ar;               {...}
01CB   40000A   829          ar = 0;                        {...}
01CC   90000Au  830          dm(txlvl1) = ar;               {...}
01CD   400C8A   831          ar = 200;                      {don't do anything for 2.00 Sec }
01CE   90000Au  832          dm(txctl_tmr) = ar;            {...}
01CF   0A000F   833          rts;                           {done, exit}
                834
                835
                836
                837   {-----------------------------------------------------------------}
                838   { ---        AC Line Voltage Monitor Subroutine                --- }
                839   {-----------------------------------------------------------------}
                840   ac_line:
01D0   400201   841          ax1 = 0x20;                    {assume we have a low line cond.}
01D1   800000u  842          ax0 = dm(aux_samples + 10);    {get the raw positive supply rail}
01D2   450004   843          ay0 = 0x5000;                  {is it less than 40V ?}
01D3   22E00F   844          ar = ax0 - ay0;                {...}
01D4   180004u  845          if lt jump low_line;           {if so, handle it}
01D5   400DF0   846          ax0 = 0x0df;                   {zero the high ac line bit}
01D6   800004u  847          ay0 = dm(bfw);                 {else, get the bit flag word}
01D7   23800F   848          ar = ax0 and ay0;              {...}
01D8   90000Au  849          dm(bfw) = ar;                  {save the result}
01D9   0A000F   850          rts;                           {done, exit}
                851   low_line:
01DA   800004u  852          ay0 = dm(bfw);                 {get the bit flag word}
01DB   23A10F   853          ar = ax1 or ay0;               {set the low line}
```

```
01DC   90000Au   854          dm(bfw) = ar;                    {save the result}
01DD   0A000F    855          rts;                             {done, exit}
                 856
                 857
                 858
                 859   {-----------------------------------------------------------------}
                 860   { ---       Alarm Output Lead Processing Subroutine            --- }
                 861   { ---       ...called every 10mS                               --- }
                 862   {-----------------------------------------------------------------}
                 863   alm_prc:
01DE   800000u   864          ax0 = dm(signal_det);            {get the current signal level}
01DF   800004u   865          ay0 = dm(signal_offset);         {...add the pot read offset}
01E0   22600F    866          ar = ax0 + ay0;                  {...}
01E1   90000Au   867          dm(signal_level) = ar;           {save the offset signal }
                 868
01E2   800006u   869          my0 = dm(noise_det);             {get the current noise channel output}
01E3   900006u   870          dm(noise_level) = my0;           {...}
                 871
01E4   800004u   872          ay0 = dm(bfw);                   {get the current bit flag word}
01E5   400EFC    873          ax0 = 0x0ef;                     {mask out the current alarm status}
01E6   27800F    874          af = ax0 and ay0;                {keep it in "af" for now}
                 875
                 876
                 877   {        ...generate a pulse when signal gate crosses noise gate        }
                 878
01E7   400800    879          ax0 = 128;                       {positive hysteresis value}
01E8   800004u   880          ay0 = dm(signal_level);          {get the current signal level}
                 881
01E9   800001u   882          ax1 = dm(old_sig);               {and the one from the last pass}
01EA   23210F    883          ar = ay0 - ax1;                  {is signal level falling ?}
01EB   900004u   884          dm(old_sig) = ay0;               {...}
01EC   180004u   885          if lt jump alarm_off;            {if so, don't alarm}
                 886
01ED   800005u   887          ay1 = dm(old_alm);               {get the old signal/noise status}
01EE   2208CF    888          ar = pass ay1;                   {was signal GT noise last time thru ?}
01EF   4FF80A    889          ar = -128;                       {assume it wasn't}
01F0   227802    890          if gt ar = pass ax0;             {if it was, set positive offset}
01F1   22620F    891          ar = ar + ay0;                   {add the offset to the signal_level}
01F2   800004u   892          ay0 = dm(noise_level);           {get the current noise level}
01F3   22E20F    893          ar = ar - ay0;                   {is signal more than noise level ? }
01F4   90000Au   894          dm(old_alm) = ar;                {..(save for next time)}
01F5   180003u   895          if le jump alm_off;              {if not, don't pulse the alarms}
01F6   180006u   896          if av jump alm_off;              {...}
01F7   800004u   897          ay0 = dm(almtrg);                {get the retrigger flag}
01F8   22000F    898          ar = pass ay0;                   {check it}
01F9   180001u   899          if ne jump alarm_off;            {if not clear, don't alarm}
01FA   40001A    900          ar = 1;                          {else, set the flag}
01FB   90000Au   901          dm(almtrg) = ar;                 {...}
01FC   800004u   902          ay0 = dm(alm_dis);               {has the alarm been disabled ? }
01FD   22000F    903          ar = pass ay0;                   {...}
01FE   180001u   904          if ne jump alarm_off;            {if so, don't pulse the alarms}
                 905
01FF   800004u   906          ay0 = dm(txctl_tmr);             {was the output level just changed ?}
0200   22000F    907          ar = pass ay0;                   {...}
0201   180001u   908          if ne jump alarm_off;            {if so, don't pulse the alarms}
                 909
0202   800004u   910          ay0 = dm(bzrtmr);                {is the buzzer already on ?}
0203   22000F    911          ar = pass ay0;                   {...}
0204   180001u   912          if ne jump buzron;               {if so, skip the turn on }
0205   80000Au   913          ar = dm(bzrtmr_ld);              {# of 10mS ticks to leave buzzer on}
0206   90000Au   914          dm(bzrtmr) = ar;                 {...}
0207   40001A    915          ar = 1;                          {turn the buzzer on}
```

```
0208   90000Au  916          dm(buzzer) = ar;                {...}
0209   400100   917          ax0 = 0x10;                     {set alarm bit in the BFW}
020A   23B00F   918          ar = ax0 or af;                 {...}
020B   90000Au  919          dm(bfw) = ar;                   {save the new bit flag word}
                920   buzron:
                921
020C   800004u  922          ay0 = dm(lmptmr);               {is the lamp already on ?}
020D   22000F   923          ar = pass ay0;                  {...}
020E   180001u  924          if ne jump lampon;              {if so, skip the turn on ?}
020F   80000Au  925          ar = dm(lmptmr_ld);             {# of 10mS ticks to leave lamp on}
0210   90000Au  926          dm(lmptmr) = ar;                {...}
0211   4C001A   927          ar = 1;                         {turn the lamp on }
0212   90000Au  928          dm(lamp) = ar;                  {...}
0213   40001A   929          ar = 1;                         {wait 10mS to make first sample}
0214   90000Au  930          dm(almchk1_tmr) = ar;           {...}
0215   40014A   931          ar = 20;                        {wait 200mS to make the second sample}
0216   90000Au  932          dm(almchk2_tmr) = ar;           {...}
0217   90000Au  933          dm(almsm1) = ar;                {...}
0218   0A000F   934          rts;                            {done, exit}
                935
                936   alm_off:
0219   40000A   937          ar = 0;                         {clear the retrigger flag}
021A   90000Au  938          dm(almtrg) = ar;                {...}
                939
                940   alarm_off:
021B   800004u  941   lampon: ay0 = dm(bzrtmr);              {get the buzzer timer}
021C   23C00F   942          ar = ay0 - 1;                   {is it running ?}
021D   180004u  943          if lt jump bzroff;              {if not, skip the buzzer processing}
                944
021E   90000Au  945          dm(bzrtmr) = ar;                {save the update timer}
021F   180001u  946          if ne jump bzroff;              {if it isn't 0 don't kill it }
0220   40000A   947          ar = 0;                         {turn off the buzzer}
0221   90000Au  948          dm(buzzer) = ar;                {...}
                949
0222   800004u  950   bzroff: ay0 = dm(lmptmr);              {get the lamp timer}
0223   23000F   951          ar = ay0 - 1;                   {is it running ?}
0224   180004u  952          if lt jump lmpoff;              {if not, skip the lamp processing}
                953
0225   90000Au  954          dm(lmptmr) = ar;                {save the updated timer}
0226   180001u  955          if ne jump lmpoff;              {if it isn't 0, don't kill it }
0227   40000A   956          ar = 0;                         {turn off the lamp}
0228   90000Au  957          dm(lamp) = ar;                  {...}
0229   22100F   958          ar = pass af;                   {...and the alarm status bit}
022A   90000Au  959          dm(bfw) = ar;                   {...}
                960
022B   800004u  961   lmpoff: ay0 = dm(almchk1_tmr);         {get the first sample timer}
022C   23000F   962          ar = ay0 - 1;                   {is it time to make the first sample?}
022D   180004u  963          if lt jump dnchk1;              {if already done, skip it}
022E   90000Au  964          dm(almchk1_tmr) = ar;           {save the updated timer}
022F   180002u  965          if gt jump dnchk1;              {if not time yet, skip it}
0230   80000Au  966          ar = dm(par_port);              {else, its time!, read status...}
0231   90000Au  967          dm(almsm1) = ar;                {...}
                968
0232   800004u  969   dnchk1: ay0 = dm(almchk2_tmr);         {get the second sample timer}
0233   23000F   970          ar = ay0 - 1;                   {is it time to make the second sample}
0234   180004u  971          if lt jump dnchk2;              {if already done, skip it }
0235   90000Au  972          dm(almchk2_tmr) = ar;           {save the updated timer}
0236   180002u  973          if gt jump dnchk2;              {if not time yet, skip it}
0237   80000Au  974          ar = dm(par_port);              {else, its time!, read status...}
0238   90000Au  975          dm(almsm2) = ar;                {...}
                976
0239   400804   977          ay0 = b#10000000;               {as soon as its read, check lamp fail}
023A   23820F   978          ar = ar and ay0;                {...}
```

```
023B   180000u  979        if eq jump lampok;          {if fail bit off, keep going }
023C   40000A   980        ar = 0;                     {if not, turn off the lamp immediately}
023D   90000Au  981        dm(lamp) = ar;              {....}
               982   lampok:
               983
023E   800001u  984        ax1 = dm(bfw);              {get the bit flag word}
023F   400FC5   985        ay1 = b#11111100;           {remove the old buzzer/lamp fail bits}
0240   27890F   986        af = ax1 and ay1;           {...}
0241   400011   987        ax1 = b#00000001;           {lamp fail bit}
0242   800004u  988        ay0 = dm(almsm1);           {get the first alarm sample}
0243   22800F   989        ar = not ay0;               {invert it}
0244   800004u  990        ay0 = dm(almsm2);           {get the second alarm sample}
0245   23A20F   991        ar = ar or ay0;             {LMPFL should be high then low}
0246   400804   992        ay0 = b#10000000;           {isolate the result}
0247   23820F   993        ar = ar and ay0;            {...}
0248   27B101   994        if ne af = ax1 or af;       {if alarm fail, modify BFW}
               995
0249   400021   996        ax1 = b#00000010;           {buzzer fail BFW bit}
024A   400400   997        ax0 = b#01000000;           {check the buzzer fail bit}
024B   800004u  998        ay0 = dm(almsm2);           {get the status again}
024C   22300F   999        ar = ax0 and ay0;           {...}
024D   27B101   1000       if ne af = ax1 or af;       {if on, set buzzer fail in BFW}
024E   22100F   1001       ar = pass af;               {save the correct BFW}
024F   90000Au  1002       dm(bfw) = ar;               {...}
               1003
               1004
0250   0A000F   1005   dnchk2: rts;                    {done, exit}
               1006
               1007
               1008
               1009
               1010   {-----------------------------------------------------------------}
               1011   { ---        Inhibit Processor Subroutine                    --- }
               1012   {-----------------------------------------------------------------}
               1013
               1014   inh_prc:
0251   800005u  1015       ay1 = dm(bfw);              {get the bit flag word}
0252   400F71   1016       ax1 = b#11110111;           {mask out the inhibit status bit}
0253   27890F   1017       af = ax1 and ay1;           {and save it in af}
0254   800000u  1018       ax0 = dm(inhbt_thrsh);      {get the inhibit trip threshold}
0255   800004u  1019       ay0 = dm(inhbt_flt);        {...and the inhibit det value}
0256   22E00F   1020       ar = ax0 - ay0;             {is the signal LT threshold ?}
0257   180003u  1021       if le jump do_inh;          {if so, go do an inhibit}
0258   22100F   1022       ar = pass af;               {set the BFW to no inhibit}
0259   90000Au  1023       dm(bfw) = ar;               {...}
025A   0A000F   1024       rts;                        {done, exit}
               1025
025B   400080   1026   do_inh: ax0 = b#00001000;      {set the inhibit flag}
025C   23B00F   1027       ar = ax0 or af;             {...}
025D   90000Au  1028       dm(bfw) = ar;               {...}
025E   40000A   1029       ar = 0;                     {Kill both alarms}
025F   90000Au  1030       dm(buzzer) = ar;            {...}
0260   90000Au  1031       dm(lamp) = ar;              {...}
0261   0A000F   1032       rts;                        {done, exit}
               1033
               1034
               1035
               1036   {-----------------------------------------------------------------}
               1037   { ---        External Sync Input Monitoring Subroutine       --- }
               1038   {-----------------------------------------------------------------}
               1039
               1040   sync_mon:
```

```
0262   800005u 1041          ay1 = dm(bfw);                  {get the bit flag word}
0263   400041  1042          ax1 = b#00000100;               {set the sync error bit}
0264   27A90F  1043          af = ax1 or ay1;                {...and save in af}
0265   23D10F  1044          ar = ax1 xor af;                {...clear the sync error bit}
0266   90000Au 1045          dm(bfw) = ar;                   {...and save in the bfw}
               1046
0267   800000u 1047          ax0 = dm(par_port);             {get the sync input bit}
0268   400204  1048          ay0 = b#00100000;               {isolate it}
0269   800005u 1049          ay1 = dm(old_sync);             {get the sync status from last time}
026A   23800F  1050          ar = ax0 and ay0;               {...}
026B   90000Au 1051          dm(old_sync) = ar;              {save the "new" old sync status}
026C   23CA0F  1052          ar = ar xor ay1;                {did the sync bit toggle ?}
026D   80000Au 1053          ar = dm(synchk_tmr);            {...get the timer }
026E   221801 1054           if ne ar = pass 0;              {if the bit toggled, reset the timer}
026F   0D004A  1055          ay0 = ar;                       {update the timer}
0270   22200F  1056          ar = ay0 + 1;                   {...}
0271   90000Au 1057          dm(synchk_tmr) = ar;            {save the sync check timer}
0272   400644  1058          ay0 = 100;                      {100 ticks without a toggle ?}
0273   22E20F  1059          ar = ar - ay0;                  {...}
0274   0A0004  1060          if lt rts;                      {if not BFW is correct (sync ok)}
0275   22100F  1061          ar = pass af;                   {get the sync error BFW}
0276   90000Au 1062          dm(bfw) = ar;                   {...}
0277   0A000F  1063          rts;                            {done, exit}
               1064
               1065
               1066   {-----------------------------------------------------------------}
               1067   { ---    Auxilliary Parameter Read Supervisory Routine        --- }
               1068   {-----------------------------------------------------------------}
               1069
               1070   aux_supv:
0278   400405  1071          ay1 = 64;                       {the timer reset count}
0279   800004u 1072          ay0 = dm(aux_tmr);              {get the auxilliary timer}
027A   23000F  1073          ar = ay0 - 1;                   {update it}
027B   22C804  1074          if lt ar = pass ay1;            {reload it if less than 0}
027C   90000Au 1075          dm(aux_tmr) = ar;               {save it}
               1076
027D   4FFFC9  1077          se = -4;                        {assume normal mode}
027E   4000F4  1078          ay0 = 0x000f;                   {...}
               1079
027F   800005u 1080          ay1 = dm(txlevl);               {are we in tx control ?}
0280   23080F  1081          ar = ay1 - 1;                   {...}
0281   180001u 1082          if ne jump notxct;              {if not, use current shift and mask}
               1083
0282   4FFFF9  1084          se = -1;                        {in tx cntrl do aux stuff 4X faster}
0283   400014  1085          ay0 = 0x0001;                   {...}
               1086   notxct:
0284   80000Au 1087          ar = dm(aux_tmr);               {get the timer back}
0285   23820F  1088          ar = ar and ay0;                {...}
0286   0A0001  1089          if ne rts;                      {if not, done, exit}
0287   800008u 1090          si = dm(aux_tmr);               {get the timer }
0288   0E100F  1091          sr = lshift si (lo);            {isolate the 2 high bits of counter}
               1092
0289   400044  1093          ay0 = 4;                        {set the next bit up}
028A   400035  1094          ay1 = 3;                        {mask}
028B   238E0F  1095          ar = sr0 and ay1;               {...}
028C   23A20F  1096          ar = ar or ay0;                 {...}
028D   0D005A  1097          ay1 = ar;                       {hold it for a moment}
               1098
028E   800004u 1099   spl0wt: ay0 = dm(sample_cnt);          {wait for sample 0}
028F   22000F  1100          ar = pass ay0;                  {... }
0290   180001u 1101          if ne jump spl0wt;              {...wait here till ready}
0291   800005u 1102          dm(aux_flag) = ay1;             {set the flag}
               1103
```

```
0292   028000  1104          idle;                          {wait for 1 interrupt }
0293   028000  1105          idle;                          {wait for another }
               1106
0294   400005  1107          ay1 = 0x0000;                  {setup to turn aux off}
0295   900004u 1108   spliwt: ay0 = dm(sample_cnt);         {wait for sample 0}
0296   22000F  1109          ar = pass ay0;                 {... }
0297   180001u 1110          if ne jump spliwt;             {...wait here till ready}
               1111
0298   900005u 1112          dm(aux_flag) = ay1;            {kill the flag}
0299   0A000F  1113          rts;                           {exit}
               1114
               1115
               1116
               1117
               1118
               1119   {-----------------------------------------------------------------}
               1120   { ---    Dual Color LED Control Routine                      --- }
               1121   {-----------------------------------------------------------------}
               1122
               1123   led_ctl:
029A   800004u 1124          ay0 = dm(txlevl);              {are we in tx control (25% V out)}
029B   23000F  1125          ar = ay0 - 1;                  {...}
029C   180000u 1126          if eq jump led_red;            {if so, make the LED red }
               1127
029D   800000u 1128          ax0 = dm(bfw);                 {get the bit flag word }
029E   400204  1129          ay0 = b#00100000;              {check the low AC line flag }
029F   23800F  1130          ar = ax0 and ay0;              {...}
02A0   180001u 1131          if nc jump led_yellow;         {if low AC go make the LED yellow }
               1132
02A1   400084  1133          ay0 = b#00001000;              {check the inhibit flag }
02A2   23800F  1134          ar = ax0 and ay0;              {... }
02A3   180001u 1135          if ne jump led_green;          {if inhibit, go make the led green}
               1136
02A4   40000A  1137          ar = 0;                        {else, turn the LED off }
02A5   90000Au 1138          dm(led_a) = ar;                {...}
02A6   90000Au 1139          dm(led_b) = ar;                {...}
02A7   0A000F  1140          rts;                           {exit }
               1141
               1142   led_red:
02A8   40000A  1143          ar = 0;                        {make the LED red}
02A9   90000Au 1144          dm(led_a) = ar;                {...}
02AA   40001A  1145          ar = 1;                        {...}
02AB   90000Au 1146          dm(led_b) = ar;                {...}
02AC   0A000F  1147          rts;                           {done, exit}
               1148
               1149   led_green:
02AD   40001A  1150          ar = 1;                        {make the LED green}
02AE   90000Au 1151          dm(led_a) = ar;                {...}
02AF   40000A  1152          ar = 0;                        {...}
02B0   90000Au 1153          dm(led_b) = ar;                {...}
02B1   0A000F  1154          rts;                           {done, exit}
               1155
               1156   led_yellow:
02B2   80000Au 1157          ar = dm(aux_tmr);              {counter toggles every 10mS}
02B3   90000Au 1158          dm(led_a) = ar;                {...}
02B4   23620F  1159          ar = not ar;                   {...}
02B5   90000Au 1160          dm(led_b) = ar;                {...}
02B6   0A000F  1161          rts;                           {done, exit}
               1162
               1163
               1164
               1165   {-----------------------------------------------------------------}
               1166   { ---   Analog to Digital Converter interrupt service routine    --- }
```

```
                1167   { ---   64 X FO                                          --- }
                1168   {-----------------------------------------------------------------}
                1169
                1170   atod_int:
02B7    0C0030  1171           ena sec_reg;                  {select the secondary register set}
02B8    0D038A  1172           si = rx1;                     {get the 12 bit signed analog input}
02B9    0F0004  1173           sr = lshift si by 4 (hi);     {turn it into a 16 bit signed value}
02BA    90000Fu 1174           dm(sample) = sr1;             {save it for the D>A routine}
                1175
                1176   {       --- Go do the Auxillary Parameter read if the flag is set  ---      }
                1177
02BB    800000u 1178           ax0 = dm(aux_flag);           {get the flag }
02BC    22780F  1179           ar = pass ax0;                {...test it}
02BD    180001u 1180           if ne jump aux_par_rd;        {if so, go do aux param read }
                1181
                1182
                1183   {       --- Run the Noise Blanker ---      }
                1184
02BE    600024  1185           mx0=dm(i1,m0);                {get long avg sample}
02BF    42AAB6  1186           my0 = 10922;                  {scale it down}
02C0    20200F  1187           mr = mx0 * my0 (rnd);         {...}
02C1    0D005C  1188           ay1 = mr1;                    {hold it in AY1 }
                1189
02C2    20270F  1190           mr = sr1 * my0 (rnd);         {scale down the input sample}
02C3    0D001C  1191           ax1 = mr1;                    {hold it in AX1 }
                1192
02C4    7329CF  1193           ar=ay1-ax1, ax0=dm(i7,m7);    {LT - AtoD, get nb1 }
02C5    267A0F  1194           af = pass ar;                 {accumulate difference in AF}
02C6    0D006A  1195           my0 = ar;                     {setup to square it}
02C7    20820F  1196           mr = ar * my0(ss);            {square and save to accumulate }
02C8    73280F  1197           ar=ay1-ax0, ax0=dm(i7,m7);    {LT - nb1, get nb2}
02C9    26720F  1198           af = ar + af;                 {accumulate difference in AF}
02CA    0D006A  1199           my0 = ar;                     {setup to square it}
02CB    21020F  1200           mr = mr + ar * my0 (ss);      {square and accumulate}
02CC    7B281D  1201           ar=ay1-ax0, dm(i7,m5)=ax1;    {LT - nb2, save the new sample}
02CD    26720F  1202           af = ar + af;                 {accumulate difference in AF}
02CE    0D006A  1203           my0 = ar;                     {setup to square it}
02CF    21020F  1204           mr = mr + ar * my0 (ss);      {square and accumulate}
02D0    050000  1205           if mv sat mr;                 {make sure we don't overflow here}
02D1    800006u 1206           my0 = dm(nb_k);               {get the "K" value }
02D2    0D002C  1207           mx0 = mr1;                    {scale the MR by "K" }
02D3    20C30F  1208           mr = mr0 * my0 (us);          {do the low word of the result}
02D4    0D008C  1209           mr0 = mr1;                    {...slide it down}
02D5    0D00CD  1210           mr1 = mr2;                    {...}
02D6    21000F  1211           mr = mr + mx0 * my0 (ss);     {add in the upper word of the result}
                1212
02D7    22100F  1213           ar = pass af;                 {get the straight (unsquared) sum}
02D8    0F32FF  1214           sr = ashift ar by -1 (lo);    {divide by 2}
02D9    0D006E  1215           my0 = sr0;                    {setup to square and accumulate}
02DA    21860F  1216           mr = mr - sr0 * my0 (ss);     {...}
02DB    050000  1217           if mv sat mr;                 {saturate it necessary}
02DC    227C0F  1218           ar = pass mr1;                {test the sign of the result}
02DD    80000Fu 1219           sr1 = dm(sample);             {assume the sample is not noisy}
02DE    40000E  1220           sr0 = 0;                      {...}
02DF    180004u 1221           if lt jump noncis;            {if not noisy, leave sample as is}
02E0    6000F5  1222           sr1 = dm(i1,m1);              {else replace it with the LT avg}
02E1    6000E7  1223           sr0 = dm(i1,m3);              {...}
02E2    90000Fu 1224   noncis: dm(nb_out) = sr1;             {save for display}
                1225
                1226
                1227   {       --- Run the averagers ---      }
                1228
02E3    0C08C0  1229           dis ar_sat;                   {required for double prec. ops }
```

```
                1230
                1231   {      --- Run the short term averager, double precision ---      }
                1232
02E4   600051   1233          ay1 = dm(i0,m1);                {get the present averager tap MSW }
02E5   600040   1234          ay0 = dm(i0,m0);                {...and the LSW}
                1235
02E6   22E60F   1236          ar = sr0 - ay0;                 {LSW of input - present tap}
02E7   0D002A   1237          mx0 = ar;                       {...save it }
02E8   22CF0F   1238          ar = sr1 - ay1 + c - 1;         {MSW of input - present tap}
                1239
02E9   403206   1240          my0 = stavg_tc;                 {get the time constant}
02EA   20C00F   1241          mr = mx0 * my0 (us);            {scale LSW of (inp-tap) by time const}
02EB   0D008C   1242          mr0 = mr1;                      {slide it into LSW of result reg}
02EC   0D00CD   1243          mr1 = mr2;                      {...}
02ED   21020F   1244          mr = mr + ar * my0 (ss);        {scale MSW and add it to the result}
                1245
02EE   22630F   1246          ar = mr0 + ay0;                 {then do the final summation}
02EF   6600A3   1247          dm(i0,m3) = ar;                 {...}
02F0   0D000A   1248          ax0 = ar;                       {...save for diff calc}
02F1   224C0F   1249          ar = mr1 + ay1 + c;             {...}
02F2   6800A2   1250          dm(i0,m2) = ar;                 {...}
02F3   0D001A   1251          ax1 = ar;                       {...save for diff calc}
02F4   90000Au  1252          dm(avg_shrt) = ar;              {save MSW of result for display}
                1253
                1254
                1255   {      --- Run the long term averager, double precision ---      }
                1256
02F5   600055   1257          ay1 = dm(i1,m1);                {get the present averager tap MSW }
02F6   600044   1258          ay0 = dm(i1,m0);                {...and the LSW}
                1259
02F7   22E60F   1260          ar = sr0 - ay0;                 {LSW of input - present tap}
02F8   0D002A   1261          mx0 = ar;                       {...save it }
02F9   22CF0F   1262          ar = sr1 - ay1 + c - 1;         {MSW of input - present tap}
                1263
02FA   400C86   1264          my0 = ltavg_tc;                 {get the time constant}
02FB   20C00F   1265          mr = mx0 * my0 (us);            {scale LSW of (inp-tap) by time const}
02FC   0D008C   1266          mr0 = mr1;                      {slide it into LSW of result reg}
02FD   0D00CD   1267          mr1 = mr2;                      {...}
02FE   21020F   1268          mr = mr + ar * my0 (ss);        {scale MSW and add it to the result}
                1269
02FF   22630F   1270          ar = mr0 + ay0;                 {then do the final summation}
0300   6800A7   1271          dm(i1,m3) = ar;                 {...}
0301   0D004A   1272          ay0 = ar;                       {...save for diff calc}
0302   224C0F   1273          ar = mr1 + ay1 + c;             {...}
0303   6800A6   1274          dm(i1,m2) = ar;                 {...}
0304   0D005A   1275          ay1 = ar;                       {...save for diff calc}
0305   90000Au  1276          dm(avg_long) = ar;              {save MSW of result for display}
                1277
                1278
                1279   {      --- compute double precision short - long ---      }
                1280
0306   22E00F   1281   endavg: ar = ax0 - ay0;                {LSW of short - long}
0307   0D008A   1282          si = ar;                        {save for scaling}
0308   22C90F   1283          ar = ax1 - ay1 + c - 1;         {MSW of short - long}
0309   0F10F3   1284          sr = lshift si by d_avg_gain-16 (lo);        {slide it up N bits}
030A   0F2AF3   1285          sr = sr or ashift ar by d_avg_gain-16 (hi);     {.....}
030B   0D00CE   1286          mr1 = sr0;                      {now saturate to 16 bits in MR}
030C   0D00DF   1287          mr2 = sr1;                      {...}
030D   05000C   1288          if mv sat mr;                   {...}
030E   90000Cu  1289          dm(d_avg) = mr1;                {that should do it !}
                1290
                1291
030F   0C0C00   1292          ena ar_sat;                     {done with multiprecision stuff}
```

```
                1293
                1294  {       --- Branch based on sample number ---        }
                1295
0310   800004u  1296          ay0 = dm(sample_cnt);          {get the sample number}
0311   4003F0   1297          ax0 = 63;                      {test if #63}
0312   23200F   1298          ar = ay0 - ax0;                {... }
0313   180000u  1299          if eq jump smpl63;             {if so, go do sample 63 code}
0314   400180   1300          ax0 = b#011000;                {mask off the insignificant bits}
0315   23800F   1301          ar = ax0 and ay0;              {...}
0316   180000u  1302          if eq jump sigphs;             {if signal phase, go do it}
0317   400104   1303          ay0 = b#010000;                {check if noise phase}
0318   23C20F   1304          ar = ar xor ay0;               {...}
0319   180000u  1305          if eq jump nsephs;             {if noise phase, go do it}
031A   18000Fu  1306          jump atod_end;                 {else, nothing to do}
                1307
                1308
                1309
                1310  {       --- Post Averager Signal Channel Processing Routine ---      }
                1311
031B   800004u  1312  sigphs: ay0 = dm(sigavg);              {get the per cycle signal channel avg}
031C   800008u  1313          si = dm(d_avg);                {get the differential average}
031D   0F30FE   1314          sr = ashift si by -2 (lo);     {divide by 4 (net 12dB gain) }
031E   23E60F   1315          ar = abs sr0;                  {full wave rectify}
031F   22520F   1316          ar = ar + ay0;                 {add to the per cycle average}
0320   90000Au  1317          dm(sigavg) = ar;               {save the result}
0321   18000Fu  1318          jump atod_end;                 {done processing}
                1319
                1320
                1321
                1322  {       --- Post Averager Noise Channel Processing Routine ---      }
                1323
0322   800004u  1324  nsephs: ay0 = dm(nseavg);              {get the per cycle noise channel avg}
0323   800008u  1325          si = dm(d_avg);                {get the differential average}
0324   0F30FF   1326          sr = ashift si by -1 (lo);     {divide by 2 (net 18dB gain) }
0325   23E60F   1327          ar = abs sr0;                  {full wave rectify}
0326   22620F   1328          ar = ar + ay0;                 {add to the per cycle average}
0327   90000Au  1329          dm(nseavg) = ar;               {save the result}
                1330
0328   800004u  1331          ay0 = dm(inhavg);              {get the per cycle inhibit averager}
0329   80000Au  1332          ar = dm(avg_shrt);             {get the short term averager tap}
032A   23E20F   1333          ar = abs ar;                   {full wave rectify}
032B   22620F   1334          ar = ar + ay0;                 {add to the per cycle average}
032C   90000Au  1335          dm(inhavg) = ar;               {save the result}
                1336
032D   18000Fu  1337          jump atod_end;
                1338
                1339
                1340  {     --- Last Sample of the Cycle ( #63)  ---  }
                1341
                1342  {       ...first lowpass filter the signal channel    }
                1343
032E   800004u  1344  smpl63: ay0 = dm(signal_det);          {get the present detector value}
032F   800000u  1345          ax0 = dm(sigavg);              {get the per cycle signal chnl avg}
0330   22E00F   1346          ar = ax0 - ay0;                {subtract present value from TP7}
0331   40A406   1347          my0 = sigch_tc;                {gate on 1.15 format multiplier}
0332   80000Cu  1348          mr1 = dm(signal_det);          {get the present peak det value again}
0333   21D20F   1349          mr = mr + ar * my0 (ss);       {scale the difference by the mult}
0334   050000   1350          if mv sat mr;                  {don't let it overflow}
0335   90000Cu  1351          dm(signal_det) = mr1;          {save the new peak detector value}
                1352
                1353  {       ...then quasi peak detect the noise channel    }
                1354
0336   800004u  1355          ay0 = dm(noise_det);           {get the present peak detector value}
```

```
0337   800000u 1356          ax0 = dm(nseavg);              {get the per cycle signal chnl avg}
0338   22E00F  1357          ar = ax0 - ay0;                {subtract present value from TP8}
0339   410006  1358          my0 = nc_chg_tc;               {charge up time constant}
033A   180002u 1359          if gt jump charge;             {if positive, my0 is charge up TC }
033B   404006  1360          my0 = nc_dis_tc;               {else, substitute discharge TC}
033C   800000u 1361   charge: mr1 = dm(noise_det);          {get the present peak det value again}
033D   21020F  1362          mr = mr + ar * my0 (ss);       {scale the difference by the mult}
033E   050000  1363          if mv sat mr;                  {don't let it overflow}
033F   900000u 1364          dm(noise_det) = mr1;           {save the new value }
               1365
               1366   {      ...then quasi peak detect the inhibit channel   }
               1367
0340   800004u 1368          ay0 = dm(inhbt_flt);           {get the present peak detector value}
0341   800000u 1369          ax0 = dm(inhavg);              {get the per cycle inhibit chnl avg}
0342   22E00F  1370          ar = ax0 - ay0;                {subtract present value from flt}
0343   47FFF6  1371          my0 = inh_chg_tc;              {charge up time constant}
0344   180002u 1372          if gt jump inhchg;             {if positive, my0 is charge up TC }
0345   404006  1373          my0 = inh_dis_tc;              {else, substitute discharge TC}
0346   800000u 1374   inhchg: mr1 = dm(inhbt_flt);          {get the present peak det value again}
0347   21020F  1375          mr = mr + ar * my0 (ss);       {scale the difference by the mult}
0348   050000  1376          if mv sat mr;                  {don't let it overflow}
0349   900000u 1377          dm(inhbt_flt) = mr1;           {save the new value }
               1378
               1379
               1380   {      ...done processing, setup for the next cycle   }
               1381
034A   40000A  1382          ar = 0x0000;                   {zero the accumulated signal average}
034B   900000u 1383          dm(sigavg) = ar;               {...}
034C   900000u 1384          dm(nseavg) = ar;               {...}
034D   900000u 1385          dm(inhavg) = ar;               {...and the accum. inhibit average}
034E   180000u 1386          jump atod_end;                 {exit from the interrupt }
               1387
               1388
               1389
               1390   {      --- Exit From The Interrupt Routine ---      }
               1391
               1392   atod_end:
               1393
034F   800004u 1394          ay0 = dm(sample_cnt);          {get the sample counter}
0350   4003F5  1395          ay1 = b#111111;                {and the mask}
0351   22200F  1396          ar = ay0 + 1;                  {update it}
0352   238A0F  1397          ar = ar and ay1;               {make it wrap around }
0353   900000u 1398          dm(sample_cnt) = ar;           {...}
               1399
0354   800000u 1400          ar = dm(inhbt_flt);            {get the inhibit detector}
0355   800004u 1401          ay0 = dm(inhbt_thrsh);         {and the threshold}
0356   800005u 1402          ay1 = dm(sample_cnt);          {is this the 2nd half of the cycle}
0357   400200  1403          ax0 = b#00100000;              {...}
0358   27880F  1404          af = ax0 and ay1;              {...}
0359   220001  1405          if ne ar = pass ay0;           {if so, display value is threshold}
035A   900000u 1406          dm(inh_disp) = ar;             {...}
               1407
035B   800004u 1408          ay0 = dm(par_port);            {calculate the DAC output}
035C   400070  1409          ax0 = b#00000111;              {8 different outputs}
035D   23800F  1410          ar = ax0 and ay0;              {...}
035E   400004u 1411          ay0 = ^nb_out;                 {...}
035F   22620F  1412          ar = ar + ay0;                 {...}
0360   0D082A  1413          i6 = ar;                       {...}
0361   700048  1414          ay0 = dm(i6,m4);               {get the output value}
0362   22A00F  1415          ar = -ay0;                     {invert it for the DAC}
0363   0F32F8  1416          sr = ashift ar by -8 (lo);     {set up for 8 bit D to A output }
0364   400804  1417          my0 = 0x80;                    {convert from signed to unsigned}
0365   22660F  1418          ar = sr0 + ay0;                {...}
```

```
0366   0D0CBA  1419          tx1 = ar;                    {send it out the serial port}
               1420
0367   0C0020  1421          dis sec_reg;                 {back to the primary register set}
0368   0A001F  1422          rti;                         {done, exit}
               1423
               1424
               1425
               1426   {-----------------------------------------------------------------}
               1427   { ---   Auxiliary Parameter Read Interrupt Service Routine     --- }
               1428   {-----------------------------------------------------------------}
               1429
               1430   aux_par_rd:
0369   800001u 1431          ax1 = dm(sample_cnt);        {get the sample counter}
036A   800000u 1432          ax0 = dm(aux_flag);          {get the flag}
036B   400034  1433          ay0 = 0x0003;                {check the two lsb's}
036C   23800F  1434          ar = ax0 and ay0;            {...}
036D   180000u 1435          if eq jump read_tx1;         {if 00, go read the tx current}
036E   23C20F  1436          ar = ar xor ay0;             {are they 11 ?}
036F   180000u 1437          if eq jump read_txv;         {if so, go read the tx voltage}
               1438                                       {else, read everything else in 1 cycle}
0370   0D0081  1439          si = ax1;                    {get the sample number}
0371   0F10FE  1440          sr = lshift si by -2 (lo);   {shift out the 2 lsb's}
0372   4000F4  1441          ay0 = 0x000f;                {isolate the input select}
0373   23860F  1442          ar = sr0 and ay0;            {...}
0374   90000Au 1443          dm(par_port) = ar;           {...}
0375   400034  1444          ay0 = b#11;                  {are the 2 lsb's of sample # = 11 }
0376   23B10F  1445          ar = ax1 and ay0;            {...}
0377   23C20F  1446          ar = ar xor ay0;             {...}
0378   180001u 1447          if ne jump atod_end;         {if not, just exit}
               1448
0379   400004u 1449          ay0 = ^aux_samples;          {get sample storage address}
037A   4000F5  1450          ay1 = 0x0f;                  {...}
037B   238E0F  1451          ar = sr0 and ay1;            {...}
037C   22620F  1452          ar = ar + ay0;               {...}
037D   0D062A  1453          i6 = ar;                     {...}
037E   80000Au 1454          ar = dm(sample);             {get the analog sample}
037F   780CA8  1455          dm(i6,m4) = ar;              {save it}
               1456
0380   4000F4  1457          ay0 = 0x000f;                {is this the last aux sample ?}
0381   23860F  1458          ar = sr0 and ay0;            {...}
0382   23C20F  1459          ar = ar xor ay0;             {...}
0383   180001u 1460          if ne jump atod_end,         {if not, done for now}
0384   80000Au 1461          ar = dm(out_img);            {else, put the parallel port back}
0385   90000Au 1462          dm(par_port) = ar;           {...}
0386   18000Fu 1463          jump atod_end;               {done, exit}
               1464
               1465
               1466
               1467   { --- Read the TX current over a full F0 cycle --- }
               1468
               1469   read_tx1:
0387   40000A  1470          ar = 0x0000;                 {set the input selector to tx current}
0388   90000Au 1471          dm(par_port) = ar;           {...}
               1472
0389   4001F4  1473          ay0 = b#00011111;            {only want a 5 bit sample count}
038A   2331CF  1474          ar = ax1 and ay0;            {...for array offset}
038B   400004u 1475          ay0 = ^tx_i;                 {...}
038C   22620F  1476          ar = ar + ay0;               {...}
038D   0D082A  1477          i6 = ar;                     {...}
               1478
038E   80000Au 1479          ar = dm(sample);             {get the analog sample value}
038F   580CA8  1480          pm(i6,m4) = ar,              {save it in the array}
               1481
```

```
039C   4003F4   1482        ay0 = 0x003f;                  {is this the last sample}
039D   23210F   1483        ar = ay0 - ax1;                {...}
039E   180001u  1484        if ne jump atod_end;           {if not, done, exit}

039F   80000Au  1485        ar = dm(out_img);              {else set the analog input back to...}
03A0   90000Au  1486        dm(par_port) = ar;             {...the front end}
03A1   18000Fu  1487        jump atod_end;                 {full cycle done, exit}
                1488
                1489
                1490   { --- Read the TX voltage over a full F0 cycle --- }
                1491
                1492   read_txv:
03A2   40009A   1493        ar = 0x0009;                   {set the input selector to tx voltage}
03A3   90000Au  1494        dm(par_port) = ar;             {...}
                1495
                1496
03A4   4001F4   1497        ay0 = b#00011111;              {only want a 5 bit sample count}
03A5   23810F   1498        ar = ax1 and ay0;              {...for array offset}
03A6   400004u  1499        ay0 = ^tx_v;                   {...}
03A7   22620F   1500        ar = ar + ay0;                 {...}
03A8   0D082A   1501        i6 = ar;                       {...}
                1502
03A9   80000Au  1503        ar = dm(sample);               {get the analog sample value}
03AA   7E00A5   1504        dm(i6,m4) = ar;                {save it in the array}
                1505
03AB   4003F4   1506        ay0 = 0x003f;                  {is this the last sample ?}
03AC   23210F   1507        ar = ay0 - ax1;                {...}
03AD   180001u  1508        if ne jump atod_end;           {if not, done, exit}
03AE   80000Au  1509        ar = dm(out_img);              {else set the analog input back to...}
03AF   90000Au  1510        dm(par_port) = ar;             {...the front end}
03B0   18000Fu  1511        jump atod_end;                 {full cycle done, exit}
                1512
                1513
                1514
                1515   { --- uC handshake subroutine --- }
                1516
                1517   hndshk:
03B1   800000u  1518        ax0 = dm(par_port);            {get the handshake lead from the micro}
03B2   400104   1519        ay0 = b#00010000;              {handshake lead mask}
03B3   23800F   1520        ar = ax0 and ay0;              {test the handshake input bit}
03B4   180001u  1521        if ne jump hndshk;             {if not active, wait}
03B5   40000A   1522        ar = 0x00;                     {if so, set the handshake lead low}
03B6   90000Au  1523        dm(hndshk_out) = ar;           {...}
                1524   hshk_wait:
03B7   80000Au  1525        ar = dm(par_port);             {get the handshake lead from the micro}
03B8   400104   1526        ay0 = b#00010000;              {test it }
03B9   23820F   1527        ar = ar and ay0;               {... }
03BA   180000u  1528        if eq jump hshk_wait;          {wait here until handshake goes high}
03BB   40001A   1529        ar = b#00000001;               {then set our handshake lead high}
03BC   90000Au  1530        dm(hndshk_out) = ar;           {...}
03BD   0A000F   1531   endpg1: rts;                        {done, return}
                1532
                1533   .endmod;                            {end of this module}
                1534
```

We claim:

1. A method of controlling the flow of composite signals to signal processing circuits wherein said composite signals include a first component of known periodicity and a second component not of said known periodicity, said method comprising the steps of comparing the amplitudes of samples of said composite signals from corresponding time intervals in each of a plurality of signal periods and switching the flow of said composite signals according to the variation in said amplitudes.

2. A method according to claim 1, wherein there are a plurality of time intervals in each signal period and wherein the amplitudes of samples from each time interval in one signal period are compared with the amplitudes of samples from corresponding time intervals in other periods.

3. A method according to claim 1, wherein said switching is arranged to permit flow, along a given signal flow path, of those composite signals which correspond to samples whose variation in amplitude from other samples with which they are compared is less than a predetermined amount.

4. A method according to claim 3, wherein, prior to said step of comparing, the amplitudes of the samples are adjusted by an amount corresponding to a weighted sum of the amplitudes from corresponding time intervals of composite signals in said given signal flow path.

5. A method of detecting the presence, in an interrogation zone, of a target capable of producing predetermined electromagnetic disturbances which repeat at a first predetermined frequency and which have distinctive characteristics defined by frequency components in a frequency band principally less than a second, higher, predetermined frequency, said method comprising the steps of:

receiving electromagnetic disturbances from said interrogation zone and producing corresponding electrical signals;

filtering from the electrical signals, frequency components above said second predetermined frequency so that all components above a third, still higher frequency are substantially eliminated;

detecting the magnitude of the remaining frequency components of said electrical signals during successive time intervals at a frequency at least twice said third frequency and which also is a multiple of said first predetermined frequency;

comparing the detected magnitudes which occur in corresponding time intervals in successive cycles of said first predetermined frequency; and producing an alarm signal in response to a predetermined comparison result.

6. A method according to claim 5, wherein said third frequency is an integral multiple of said first predetermined frequency.

7. A method according to claim 5, wherein said remaining frequency components are processed to restore the relative phase relationships of their respective frequency components which were shifted in removing frequency components.

8. A method of detecting the presence, in an interrogation zone, of a target capable of producing predetermined electromagnetic disturbances which repeat at a first predetermined frequency, said method comprising the steps of:

receiving electromagnetic disturbances from said interrogation zone and producing corresponding electrical signals;

detecting the magnitude of the electrical signals during successive time intervals, said time intervals occurring at a second frequency which is a predetermined multiple of said first predetermined frequency;

comparing the detected magnitudes of said electrical signals which occur in corresponding time intervals in successive cycles of said first predetermined frequency to produce an alarm; and preventing the production of an alarm when the variation among detected magnitudes in a predetermined number of successive cycles exceeds a predetermined value.

9. A method according to claim 8, wherein the square of the sums of said detected magnitudes for said predetermined number of successive cycles is compared to the product of: (a) a predetermined value between zero and one, (b) said predetermined number, and (c) the sum of the squares of said detected magnitudes.

10. A method according to claim 9, wherein, prior to comparing the detected magnitudes, each magnitude is decreased by an amount corresponding to a weighted sum of preceding magnitudes which occurred in corresponding time intervals in successive cycles of said first predetermined frequency.

11. A method according to claim 8, wherein, prior to comparing the detected magnitudes, each magnitude is decreased by an amount corresponding to a weighted sum of preceding magnitudes which occurred in corresponding time intervals in successive cycles of said first predetermined frequency.

12. A method of detecting the presence of a target in an interrogation zone, said method comprising the steps of:

detecting the electromagnetic radiation in said interrogation zone and producing electrical signals corresponding to said radiation;

filtering from said electrical signals selected frequency components;

restoring to the remaining components the relative phase relationship said remaining components had to each other prior to filtering; and detecting the presence of a predetermined pulse in the restored components.

13. A method according to claim 12, wherein said remaining components have, at successive times, corresponding magnitudes, and wherein the step of restoring comprises altering said corresponding magnitudes by predetermined amounts and combining the altered magnitudes.

14. A method according to claim 13, wherein said step of altering said corresponding magnitudes comprises directing said remaining components through a delay circuit having taps therealong, recovering a signal sample at each of said taps simultaneously, selectively altering the magnitude of each signal sample and combining the altered signal samples.

15. A method according to claim 14, wherein the step of altering comprises the step of passing said signals through multipliers.

16. A method according to claim 14, wherein said step of combining the altered signal samples comprises summing the magnitudes of said altered signal samples.

17. A method according to claim 14, wherein said step of altering the magnitude of each signal sample comprises passing each signal sample through a signal multiplier whose other input is a tap coefficient.

18. A method according to claim 17, wherein said step of combining the altered signal samples comprises summing the magnitudes of said altered signal samples.

19. A method according to claim 12, wherein said step of restoring is carried out in a signal processing device and wherein said method includes, prior to detecting the presence of pulses in the restored components, the further steps of applying electrical test signals, which are ideally representative of a target, to said signal processing device, comparing the output of said signal processing device to a signal representative of a proper output to produce an error signal and adjusting said signal processing device to minimize said error signal.

20. A method according to claim 19, wherein said adjustable signal processing device includes a signal delay circuit having a given delay period, wherein said electrical signals are periodic and have a period equal to a multiple M of said given delay period and wherein said electrical signals are applied to said signal delay circuit for a duration of several M multiples of said delay period prior to the step of detecting the presence of pulses in the restored components.

21. Apparatus for controlling the flow of composite signals to signal processing circuits wherein said composite signals include a first component of a known periodicity and a second component not of said known periodicity, said apparatus comprising a signal comparator arranged to compare the amplitudes of samples of said composite signals from corresponding time intervals in each of a plurality of signal periods and a switch arranged to switch the flow of said composite signals in response to the output of said signal comparator.

22. Apparatus according to claim 21, wherein there are a plurality of time intervals in each signal period and wherein a separate signal comparator is connected to compare the amplitudes of samples in each time interval.

23. Apparatus according to claim 21, wherein said switch is connected to permit flow along a given flow path of those composite signals which correspond to samples whose variation in amplitude from other samples with which they are compared is less than a predetermined amount.

24. Apparatus according to claim 23, wherein said apparatus includes a signal averaging device connected and arranged to produce a weighted sum of the composite signals passed by said switch along said flow path and a circuit arranged to adjust the amplitudes of said samples according to the output of said signal averaging device.

25. Apparatus for detecting the presence, in an interrogation zone, of a target capable of producing predetermined electromagnetic disturbances which repeat at a first predetermined frequency and which have distinctive characteristics defined by frequency components in a frequency band principally less than a second, higher, predetermined frequency, said apparatus comprising:

an antenna and receiver constructed and arranged to receive electromagnetic disturbances from said interrogation zone and to produce corresponding electrical signals;

a filter constructed and arranged to attenuate the frequency components of said electrical signals above said second predetermined frequency so that frequency components above a third, still higher frequency are effectively eliminated;

a detector connected to detect the magnitude of the remaining frequency components of said electrical signals during successive time intervals, said time intervals at a frequency which is at least twice said third predetermined frequency and which also is a multiple of said first predetermined frequency;

a comparison circuit connected to compare the detected magnitudes which occur in corresponding time intervals in successive cycles of said first predetermined frequency; and an alarm arranged to receive outputs from said comparator and to produce an alarm signal in response to a predetermined comparison result.

26. Apparatus according to claim 25, wherein said third predetermined frequency is an integral multiple of said first predetermined frequency.

27. Apparatus according to claim 25, wherein a processor is connected to receive signals from said filter, said processor including a comparison circuit and being arranged to process the remaining frequency components of said electrical signals so as to restore the relative phase relationships of their respective frequency components which were shifted by said filter.

28. Apparatus for detecting the presence, in an interrogation zone, of a target capable of producing predetermined electromagnetic disturbances which repeat at a first predetermined frequency, said apparatus comprising:

an antenna and receiver constructed and arranged to receive electromagnetic disturbances from said interrogation zone and to produce corresponding electrical signals;

a detector connected to detect the magnitude of the electrical signals during successive time intervals, said time intervals occurring at a second frequency which is a predetermined multiple of said first predetermined frequency;

a comparison circuit constructed and connected to compare the detected magnitudes of said electrical signals which occur in corresponding time intervals in successive cycles of said first predetermined frequency to produce an alarm; and a signal processing circuit constructed and arranged to prevent the production of an alarm when the variation among detected magnitudes in a predetermined number or successive cycles exceeds a predetermined value.

29. Apparatus according to claim 28, wherein said circuit arrangement is connected to compare the square of the sums of said detected magnitudes, for a predetermined number of successive cycles to the product of: (a) a predetermined value between zero and one, (b) said predetermined number, and (c) the sum of the squares of said detected magnitudes.

30. Apparatus according to claim 29, wherein said circuit arrangement is constructed and connected to decrease each magnitude by an amount corresponding to a weighted sum of preceding magnitudes which occurred in corresponding time intervals in successive cycles of said first predetermined frequency, prior to comparing the detected magnitudes.

31. Apparatus according to claim 28, wherein said circuit arrangement is constructed and connected to decrease each magnitude by an amount corresponding to a weighted sum of preceding magnitudes which occurred in corresponding time intervals in successive cycles of said first predetermined frequency, prior to comparing the detected magnitudes.

32. Apparatus for detecting the presence of a target in an interrogation zone, said apparatus comprising:

a receiver constructed and arranged to receive and detect the electromagnetic radiation in said interrogation zone and to produce electrical signals corresponding to said radiation;

a filter connected t filter from said electrical signals selected frequency components;

a signal processing circuit constructed and arranged to restore to the remaining components the relative phase relationship said remaining components had to each other prior to filtering; and a detector connected to detect the presence of a predetermined pulse in the restored components.

33. Apparatus according to claim 32, wherein said signal processing circuit includes a circuit arrangement connected to receive and detect the magnitudes of the remaining components which occur at successive times, to alter the detected magnitudes by predetermined amounts and to combine the altered magnitudes.

34. Apparatus according to claim 33 wherein said circuit arrangement comprises a delay circuit having taps therealong to recover signal samples from different locations, simultaneously, along said delay line, and signal altering elements connected to said taps to selectively amplify or attenuate the magnitude of the signals passing therethrough.

35. Apparatus according to claim 34, wherein said signal altering elements are multipliers.

36. Apparatus according to claim 34, wherein said circuit arrangement includes a signal summer connected to sum the magnitudes of the altered signal samples.

37. Apparatus according to claim 36, and further including a signal generator for generating idealized pulses representative of signals produced by an ideal target in said interrogation zone and a training/operation switch connected to supply signals to said filter alternately from said signal generator and from said receiver.

38. Apparatus according to claim 32, and further including a signal generator for generating idealized pulse signals representative of signals produced by a target in said interrogation zone and a training/operation switch connected to supply signals to said filter alternately from said signal generator and from said receiver.

* * * * *

UNITED STATES PATENT AND TRADEMARK OFFICE

CERTIFICATE OF CORRECTION

PATENT NO. : 5,264,829

DATED : November 23, 1993

INVENTOR(S) : PAUL, EL AL.

It is certified that error appears in the above-identified patent and that said Letters Patent is hereby corrected as shown below:

Title page,

AT [56] REFERENCED CITED

Other Publications, under An Automatic etc., "vol. VLIV," should read --vol. XLIV--.

COLUMN 4

Line 55, "and" should be deleted.

COLUMN 8

Line 12, "is" (1st occurrence) should read --in--.

COLUMN 9

Line 34, "-13,952" should read --13,952--.

COLUMN 10

Line 60, "elements 94," should read --elements $94_1$,--.

COLUMN 14

Line 45, "divide" should read --divided--.

COLUMN 16

Line 31, "is" (1st occurrence) should be deleted.

UNITED STATES PATENT AND TRADEMARK OFFICE

CERTIFICATE OF CORRECTION

PATENT NO. : 5,264,829

DATED : November 23, 1993

INVENTOR(S) : PAUL, EL AL.

It is certified that error appears in the above-identified patent and that said Letters Patent is hereby corrected as shown below:

COLUMN 59

Source 678, "is" should read --are--.

COLUMN 71

Source 1067, "Auxilliary" should read --Auxiliary--.

COLUMN 90

Line 60, "t" should read --to--.

COLUMN 92

Line 9, "claim 32," should read --claim 36,--.

Signed and Sealed this

Thirtieth Day of May, 1995

Bruce Lehman

*Attest:*

BRUCE LEHMAN

*Attesting Officer*

*Commissioner of Patents and Trademarks*